US006019036A

United States Patent [19]

Ohkawa

[11] Patent Number: 6,019,036

[45] Date of Patent: Feb. 1, 2000

[54] STENCIL PRINTER

[75] Inventor: Eiji Ohkawa, Watari-gun, Japan

[73] Assignee: Tohoku Ricoh Co., Ltd., Shibata-gun, Japan

[21] Appl. No.: 09/000,970

[22] Filed: Dec. 30, 1997

[30] Foreign Application Priority Data

Jan. 16, 1997 [JP] Japan ..... 9-005230
Nov. 5, 1997 [JP] Japan ..... 9-302523

[51] Int. Cl.[7] ..... B41L 13/04

[52] U.S. Cl. ..... 101/116; 101/247

[58] Field of Search ..... 101/114, 116, 101/119, 120, 218, 247; 74/571 R, 571 M, 63, 68

[56] References Cited

U.S. PATENT DOCUMENTS 3,630,146 12/1971 Shields ..... 101/351.4
4,712,447 12/1987 Langner ..... 74/571 R
5,070,366 12/1991 Tsuchiya ..... 74/68
5,320,506 6/1994 Fogt ..... 418/55.3
5,376,954 12/1994 Kerr ..... 101/483

FOREIGN PATENT DOCUMENTS 9-001914 1/1997 Japan .
9-216448 8/1997 Japan .

*Primary Examiner*—Ren Yan
*Attorney, Agent, or Firm*—Oblon, Spivak, McClelland, Maier & Neustadt, P.C.

[57] ABSTRACT

A stencil printer of the present invention includes an ink drum and a press drum rotatable with a paper or similar recording means wrapped therearound while pressing the paper against the ink drum. A moving mechanism selectively moves the press drum into or out of contact with the ink drum in synchronism with the feed of the paper order to prevent the press drum from contacting the ink drum when the paper is absent therebetween. Even when the moving mechanism angularly moves the press drum, the press drum is free from a change in peripheral speed and can surely catch the leading edge of the paper. Drive transmission to the press drum is implemented by an Oldham coupling or a universal coupling.

5 Claims, 16 Drawing Sheets

STENCIL PRINTER

BACKGROUND OF THE INVENTION

The present invention relates to a stencil printer of the type including an ink drum and a press drum rotatable with a paper or similar recording medium wrapped therearound while pressing it against the ink drum.

In a stencil printer of the type described, heating elements arranged on a thermal head are selectively energized to perforate, or cut, a thermosensitive stencil made up of a thermoplastic resin film and a porous substrate. The perforated stencil or master is wrapped around an ink drum made up of a porous support and a mesh screen. The mesh screen is implemented as a plurality of metallic mesh layers. While ink is fed from an ink feed member to the inner periphery of the ink drum, a press roller or similar pressing means sequentially presses a paper or similar recording medium against the master. As a result, the ink oozes out through a porous portion included in the ink drum and the perforations of the master, printing a desired image on the paper.

This type of stencil printer should preferably have its press drum and ink drum spaced from each other when the paper is absent therebetween. Specifically, when the paper does not exist between the ink drum and the press drum, e.g., in a power-off state or during master feeding or discharging operation, the press drum must be released from the ink drum. Should the press drum directly contact the ink drum, ink would be transferred from the ink drum to the press drum and would thereby smear the rear of a paper during printing. In light of this, the conventional stencil printer includes moving means for selectively moving the press drum into or out of contact with the ink drum.

Assume that the press drum is rotated counterclockwise at the same peripheral speed as the ink drum. Then, when the press drum is released from the ink drum, it moves at a higher peripheral speed than the ink drum due to the particular configuration and operation of the moving means. Conversely, when the press drum is pressed against the ink drum, it moves at a lower peripheral speed than the ink drum. Such a change in the peripheral speed of the press drum is apt to cause a catch mounted on the press drum to fail to catch the paper at an adequate timing. In practice, a variation in the peripheral speed of the press drum is about 1.5 times as great as the peripheral speed of the ink drum, causing the press drum to fail to catch the paper.

Further, with the configuration and operation of the conventional moving means, it is likely that the positional relation between clamping means mounted on the ink drum and the catch of the press drum is varied. This eventually dislocates an image on the paper. It is therefore necessary to mount a new press roller with the greatest care, resulting in extremely difficult assembly.

Technologies relating to the present invention are disclosed in, e.g., Japanese Patent Laid-Open Publication Nos. 9-216448 and 9-1914.

SUMMARY OF THE INVENTION

It is therefore an object of the present invention to provide a stencil printer capable of obviating an occurrence that a press drum fails to catch a paper due to a change in its peripheral speed.

It is another object of the present invention to provide a stencil printer promoting easy assembly of a press drum at the time of maintenance.

A stencil printer of the present invention includes a cylindrical ink drum including an ink feeding device and rotatable with a perforated master wrapped around its periphery. A cylindrical press drum retaines a recording medium fed from a recording medium feeding section on its periphery and is rotatable in the direction opposite to the direction of rotation of the ink drum while pressing the recording medium against the ink drum. A moving mechanism selectively moves the press drum into or out of contact with the ink drum in synchronism with the feed of the recording medium to thereby prevent the press drum from contacting the ink drum when the recording medium is absent therebetween. A drive transmitting device connects the press drum and a press drum driveline arranged on stationary members which are not influenced by the displacement of the press drum caused by the moving means. The drive transmitting device causes, during and before and after the displacement of the press drum, the press drum to rotate smoothly in accordance with the rotation of the press drum driveline without any variation in speed despite the displacement of the press drum.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
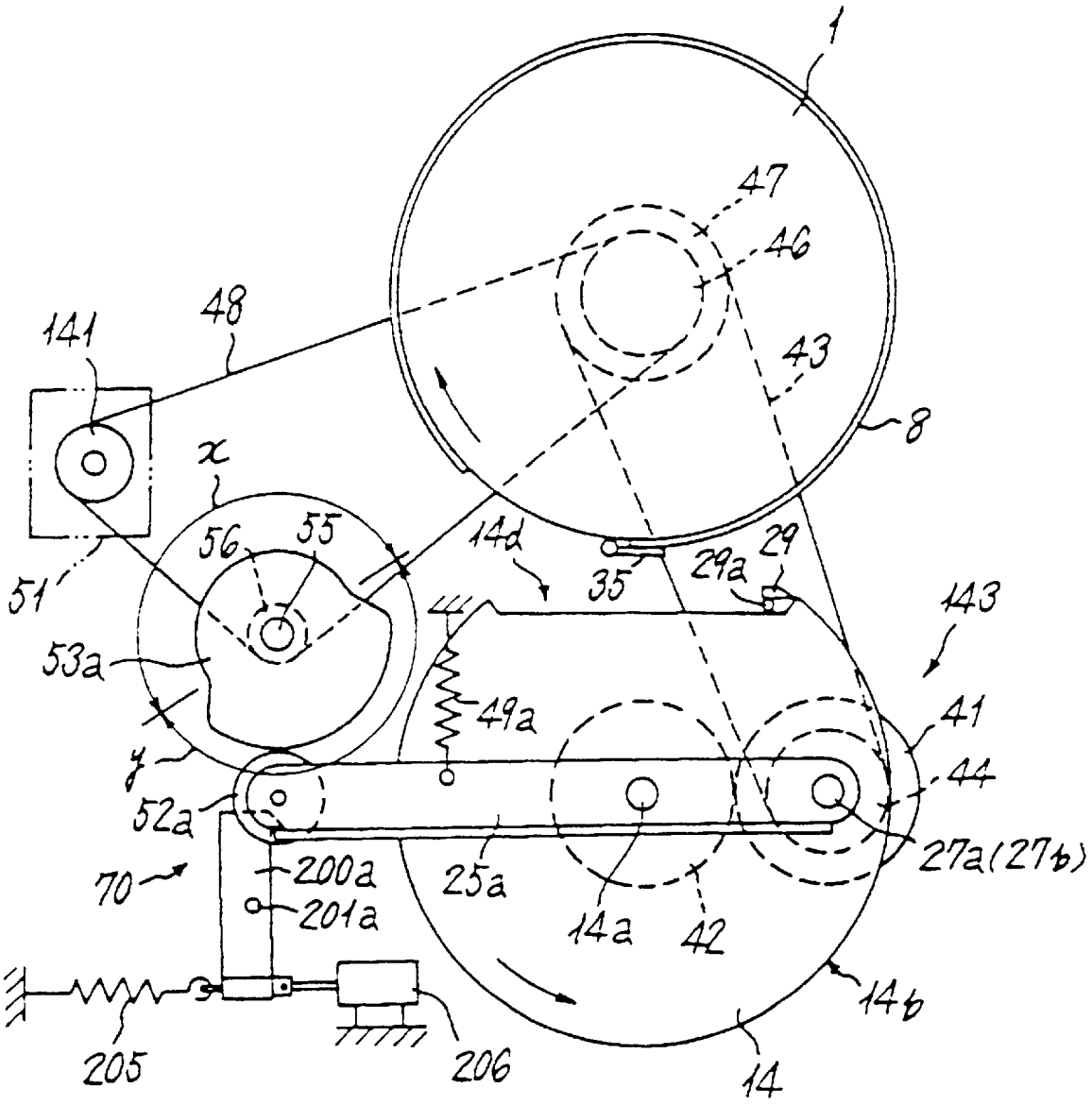
FIG. 1 PRIOR ART
FIG. 1 shows a driveline included in a conventional stencil printer for driving an ink drum and a press drum.

To better understand the present invention, reference will be made to a conventional stencil printer, shown in FIGS. 1 and 2. As shown, the stencil printer includes an ink drum 1 and a press drum 14. The ink drum 1 has a hollow cylindrical configuration and has ink feeding means arranged therein-side. The ink drum 1 is rotatable with a master or cut stencil 8 wrapped therearound. Clamping means 35 is provided on the ink drum 1 in order to clamp the leading edge of the master 8. The press drum 14 also has a cylindrical configuration and is rotatable in the opposite direction to the ink drum 1 while pressing a paper or similar recording medium wrapped therearound against the ink drum 1. The press drum 14 has substantially the same diameter as the ink drum 1. Moving means 70 selectively moves the press drum 14 into or out of contact with the ink drum 1 in synchronism with the feed of the paper. This successfully prevents the ink drum 14 and press drum 1 from contacting each other when the paper is absent therebetween.

Figure 2:
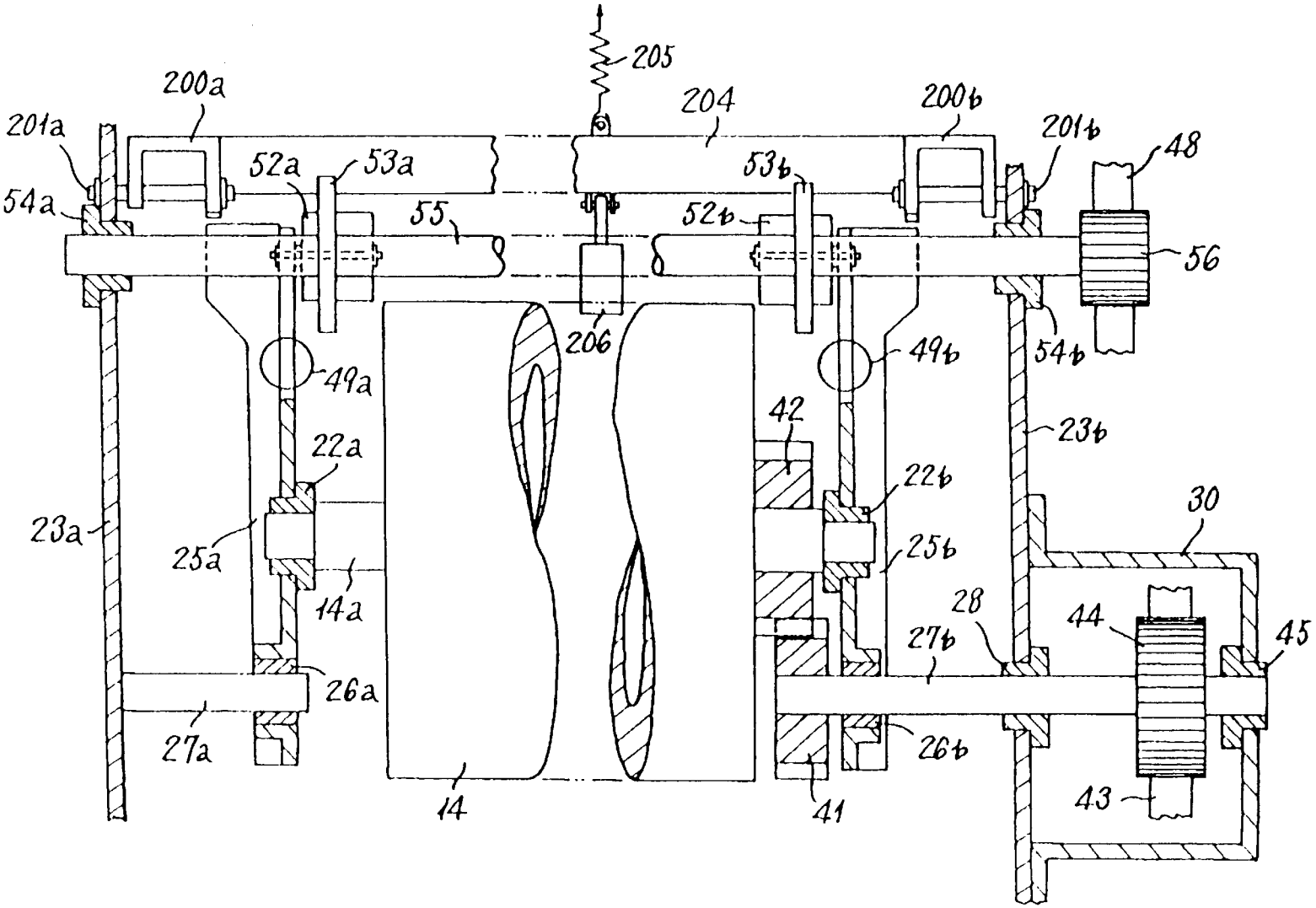
FIG. 2 PRIOR ART
FIG. 2 shows how the press drum of the conventional printer is supported, together with a drive system assigned to the press drum.

As shown in FIG. 2, the press drum 14 is fixedly mounted on a shaft 14*a*. The shaft 14*a* has its opposite ends rotatably supported by bearings 22*a* and 22*b* mounted on arms 25*a* and 25*b*, respectively. One end of the arm 25*a* is rotatably supported by a shaft 27*a* via a bearing 26*a*. The shaft 27*a* is affixed to one side wall 23*a* of the printer. Likewise, one end of the arm 25*b* is rotatably supported by a shaft 27*b* via a bearing 26*b*. The shaft 27*b* is rotatably supported by a bearing 28 mounted on the other side wall 23*b* of the printer and a bearing 45 mounted on a cover 30 affixed to the side wall 23*b*.

An idle gear 41 is affixed to one end of the shaft 27*b* in order to allow the press drum 14 to rotate in the opposite direction to the ink drum 1, i.e., to cause the former to move in the same direction as the latter at the nip. A gear 42 is affixed to the shaft 14*a* of the drum 14 and held in mesh with the gear 41. A toothed pulley 44 is affixed to the shaft 27*b* within the cover 30 in order to transfer rotation to the drum 1. As shown in FIG. 1, a toothed pulley 46 is provided integrally with the ink drum 1. A toothed pulley 47 is provided integrally and concentrically with the toothed pulley 46. A toothed belt 43 is passed over the two pulleys 47 and 44.

A shaft 55 is supported by the side walls 23*a* and 23*b* via bearings 54*a* and 54*b*. Cams 53*a* and 53*b* are mounted on the shaft 55. A toothed pulley 56 is mounted on the end of the shaft 55 protruding from the side wall 23. A toothed pulley 141 is mounted on the output shaft of a motor 51. A toothed belt 48 is passed over the pulleys 141, 46 and 56. When the motor 51 rotates, it causes the pulleys 46 and 56 to rotate via the belt 48 with the result that the ink drum 1 and cams 53*a* and 53*b* rotate in synchronism with each other. At the same time, the pulleys 47 and 44 are rotated via the belt 43. Consequently, the ink drum 14 rotates in synchronism with, but in the opposite direction to, the ink drum 1.

As shown in FIG. 1, the press drum 14 has a contact portion 14*b* having substantially the same diameter as the ink drum 1, and a recessed non-contact portion 14*d*. The contact portion 14*b* is capable of contacting the ink drum 1. The non-contact portion 14*d* has a catch 29 for catching the leading edge of the paper. The catch 29 has its base end affixed to a shaft 29*a* also included in the non-contact portion 14*d*. A spring, not shown, constantly biases the catch 29 in the direction in which the catch 29 tends to close. A cam, not shown, causes the catch 29 to open or close at a preselected timing. At the time of printing, the paper is fed toward the press drum 14 in synchronism with the movement of the master 8 wrapped around the drum 1. When the leading edge of the paper arrives at the catch 29 held in its open position, the catch 29 is closed so as to nip the leading edge of the paper. Subsequently, the arms 25*a* and 25*b* are rotated at a preselected timing based on the rotation of the cams 53*a* and 53*b*. As a result, the press drum 14 is pressed against the ink drum 1 by springs 49*a* and 49*b* with the intermediary of the paper, causing an image to be printed on the paper.

During printing, i.e., when the paper is present between the ink drum 1 and press drum 14, it is necessary that the drum 14 be pressed against the drum 1. However, when the paper does not exist between the ink drum 1 and the press drum 14, e.g., in a power-off state or during master feeding or discharging operation, the press drum 14 must be released from the ink drum 1. Should the press drum 14 directly contact the ink drum 14, ink would be transferred from the drum 1 to the drum 14 and would thereby smear the rear of a paper during printing.

The moving means 70 mentioned earlier selectively brings the press drum 14 into or out of contact with the ink drum 1. As shown in FIGS. 1 and 2, the moving means 70 mainly consists of the arms 25*a* and 25*b* for rotating the press drum 14 about the shafts 27*a* and 27*b*, rollers 52*a* and 52*b* rotatably mounted on the other ends of the arms 25*a* and 25*b*, respectively, the springs 49*a* and 49*b* biasing the arms 25*a* and 25*b* toward the ink drum 1, the cams 53*a* and 53*b* contacting the rollers 52*a* and 52*b*, respectively, hook levers 200*a* and 200*b*, a stay 204, a tension spring 205, and a solenoid 206.

The hook levers 200*a* and 200*b* are respectively disengageable from the ends of 25*a* and 25*b* and respectively rotatably mounted on shafts 201*a* and 201*b* affixed to the side walls 23*a* and 23*b*. The hook levers 200*a* and 200*b* are connected to each other by the stay 204. The stay 204 is implemented by a box-like plate as thin as about 0.6 mm to 0.8 mm for a light weight configuration.

The tension spring 205 constantly pulls the intermediate portion of the stay 204. In this condition, the hook levers 200*a* and 200*b* and arms 25*a* and 25*b* are held in engagement against the action of the springs 49*a* and 49*b* biasing the arms 25*a* and 25*b* upward. When the solenoid 206 located at the opposite side to the spring 205 is energized, it causes the cams 53*a* and 53*b* to rotate. As soon as larger diameter portions y included in the cams 53*a* and 53*b* respectively contact the rollers 52*a* and 52*b*, the arms 25*a* and 25*b* are slightly lowered against the action of the springs 49*a* and 49*b*, producing small gaps between the hook levers 200*a* and 200*b* and the arms 25*a* and 25*b*. As a result, the hook levers 200*a* and 200*b* are allowed to rotate against the action of the spring 205 and are therefore released from the arms 25*a* and 25*b*.

In the above condition, the arms 25*a* and 25*b* are rotated due to the rotation of the cams 53*a* and 53*b* under the action of the springs 49*a* and 49*b*. Consequently, the contact portion 14*b* of the press drum 14 is brought into contact with the ink drum 1. In this manner, the press drum 14 is selectively brought into or out of contact with the ink drum 1.

During printing, i.e., when the paper exists between the ink drum 1 and the press drum 14, smaller diameter portions x also included in the cams 53*a* and 53*b* are caused to respectively face the rollers 52*a* and 52*b* in synchronism with a paper feed command. The press drum 14 is therefore pressed against the ink drum 1 with the intermediary of the paper. At this instant, the springs 49*a* and 49*b* urge the press drum 1 against the ink drum 14 evenly because the springs 49*a* and 49*b* are anchored to the arms 25*a* and 25*b*, respectively. So long as the paper is present between the ink drum 1 and the press drum 14, the drum 14 is continuously pressed against the drum 14 via the paper. As soon as the trailing edge of the paper moves away from the nip between the two drums 1 and 14, the larger diameter portions y of the cams 53*a* and 53*b* are caused to face the rollers 52*a* and 52*b*, releasing the press drum 14 from the print drum 1. In this manner, during printing, the press drum 14 is rotated for every paper in accordance with the rotation of the cams 53*a* and 53*b*.

As stated above, the arms 25*a* and 25*b* are respectively rotatable about the shafts 27*a* and 27*b*, causing the press drum 14 to rotate every time a paper is passed. When the arm 25*b* rotates about the shaft 27*b*, it causes the gear 42 held in mesh with the gear 41 to rotate.

Figure 3:
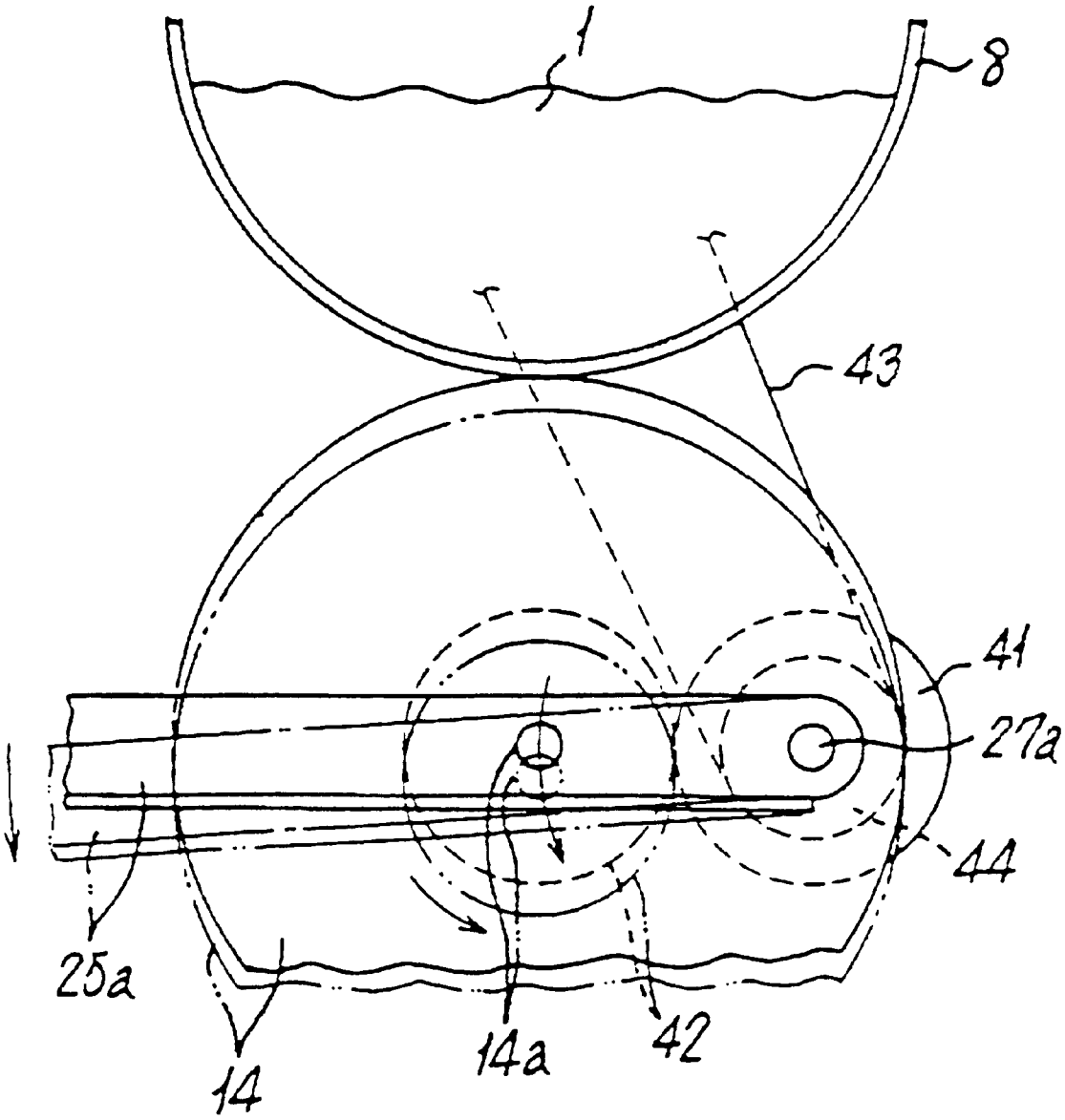
FIG. 3 PRIOR ART
FIGS. 3 and 4 schematically show the drive system of FIG. 2 for describing why the speed of the press drum included in the conventional printer varies due to the angular movement of arms.

In FIG. 3, assume that the press drum 14 is rotated counterclockwise at the same peripheral speed as the ink drum 1. Also, assume that the cams 53*a* and 53*b* are so controlled as to lower the free ends of the arms 25*a* and 25*b* in order to release the press drum 14 from the ink drum 1. Then, the arms 25*a* and 25*b* rotate about the shafts 27*a* and 27*b*, respectively. Because the gear 41 is affixed to the shaft 27*b* and held in mesh with the gear 42 and because the distance between the axes of the gears 41 and 42 remains constant despite the rotation, the gear 42 rotate around the gear 41 like a planetary gear. Therefore, when the arm 25*b* is lowered, the gear 42 moves downward along the periphery of the gear 41 while rotating counterclockwise, as viewed in FIG. 3. Because the gear 42 is mounted on the press drum 14, the drum 14 also rotates counterclockwise by the same amount as the gear 42. Consequently, while the arms 25*a* and 25*b* are moved downward, the press drum 14 moves at a higher peripheral speed than the ink drum 1 due to the above rotation of the gear 42.

Figure 4:
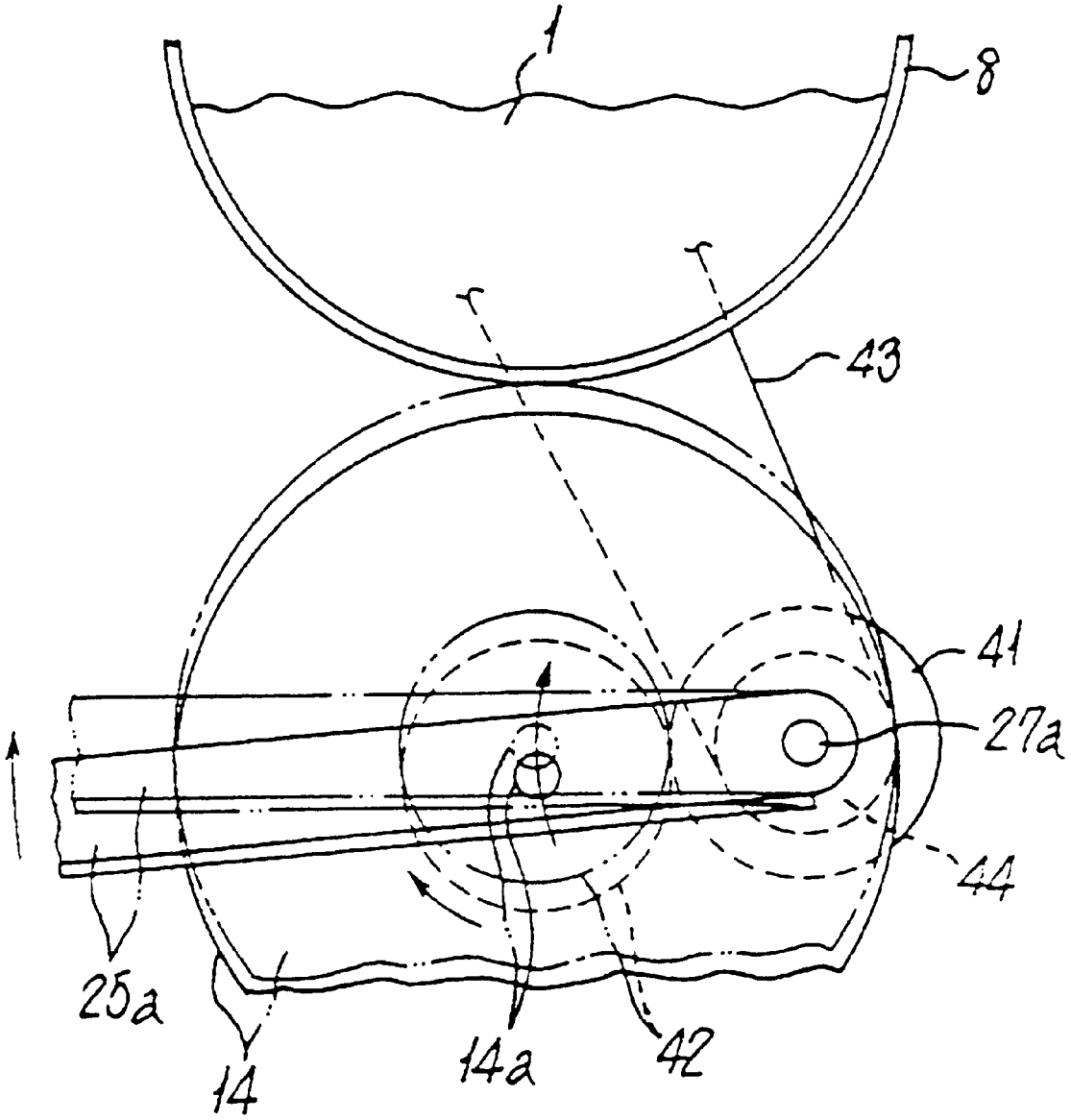
FIG. 4 PRIOR ART

On the other hand, assume that the cams 53*a* and 53*b* are so controlled as to raise the free ends of the arms 25*a* and 25*b* in order to press the press drum 14 against the ink drum 1. Then, the gear 42 moves upward along the periphery of the gear 41 while rotating clockwise, as viewed in FIG. 4. The press drum 14 carrying the gear 42 therewith also rotates clockwise by the same amount as the gear 42. As a result, while the arms 25*a* and 25*b* are moved upward, the press drum 14 moves at a lower peripheral speed than the ink drum 1 due to the above rotation of the gear 42.

The catch 29 is mounted on the non-contact portion 14*b* of the press drum 14. The paper is fed from a registration roller pair 13, which will be described, toward the press drum 14 at a speed identical with the peripheral speed of the ink drum 1. However, the catch 29 is apt to fail to nip the paper at an adequate timing due to the change in the peripheral speed of the press drum 14 ascribable to the rotation of the arms 25*a* and 25*b* stated above.

The drive transmission to the press drum 14 is implemented by the gears 42 and 41 held in mesh with each other. This brings about a problem that if the mesh between the gears 42 and 42 is deviated even by a single tooth, the positional relation between the clamping means 35 of the ink drum 1 and the catch 29 of the press drum 14 is varied. This eventually dislocates an image on the paper. On the other hand, the surface of the press drum 14 is formed of an elastic material and therefore often scratched or otherwise damaged by a peeler 15, which will be described, in the event of paper discharge. While the damaged press drum 14 is replaced with a new press roller at the time of maintenance, it is necessary to mount the new press roller with the greatest care such that the gears 42 and 41 accurately mesh with each other. This kind of mounting operation is extremely difficult to perform.

Figure 5:
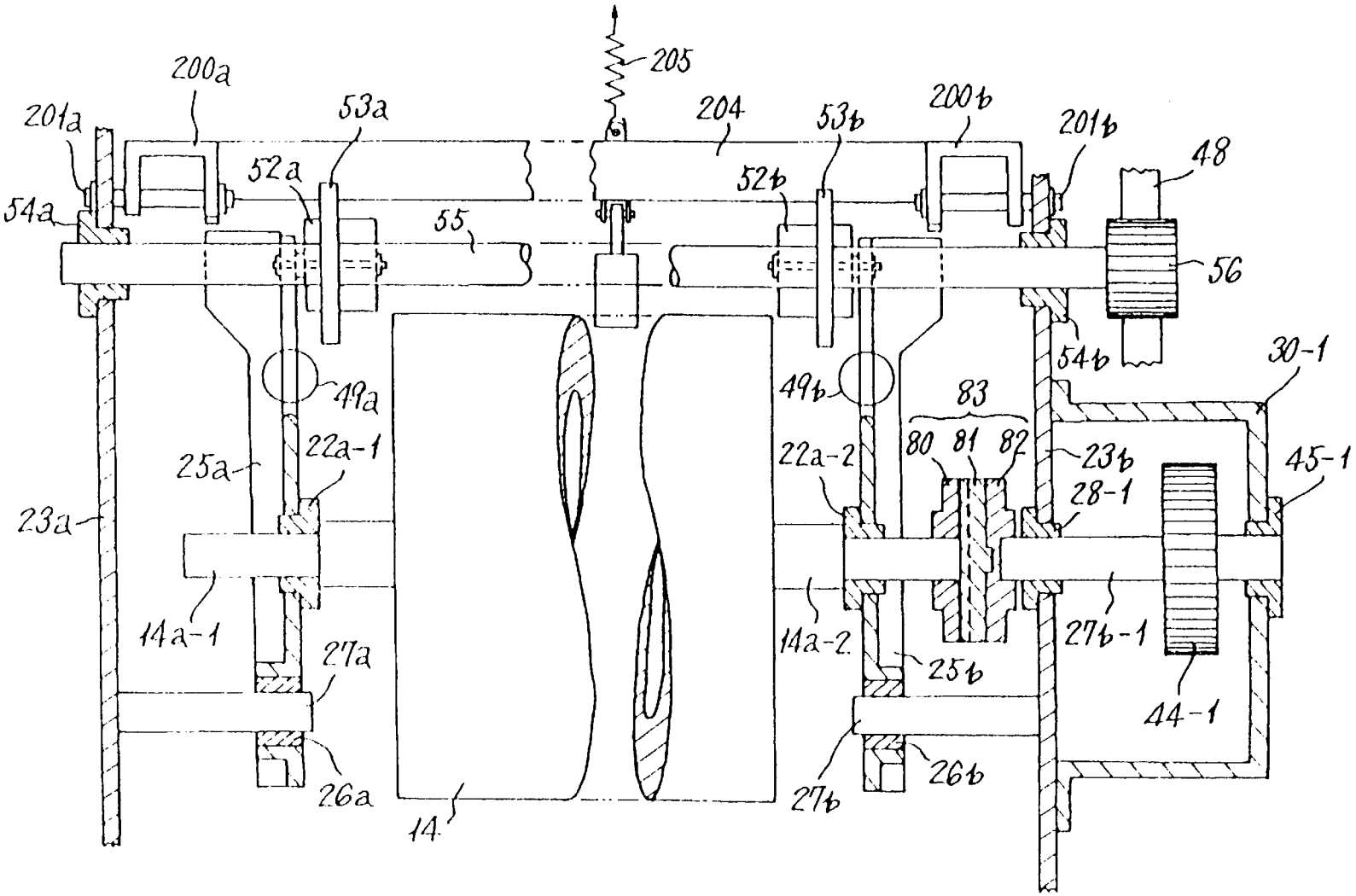
FIG. 5 is a fragmentary section showing a stencil printer embodying the present invention, particularly an arrangement for supporting a press drum and a drive system assigned to the press drum.
Figure 6:
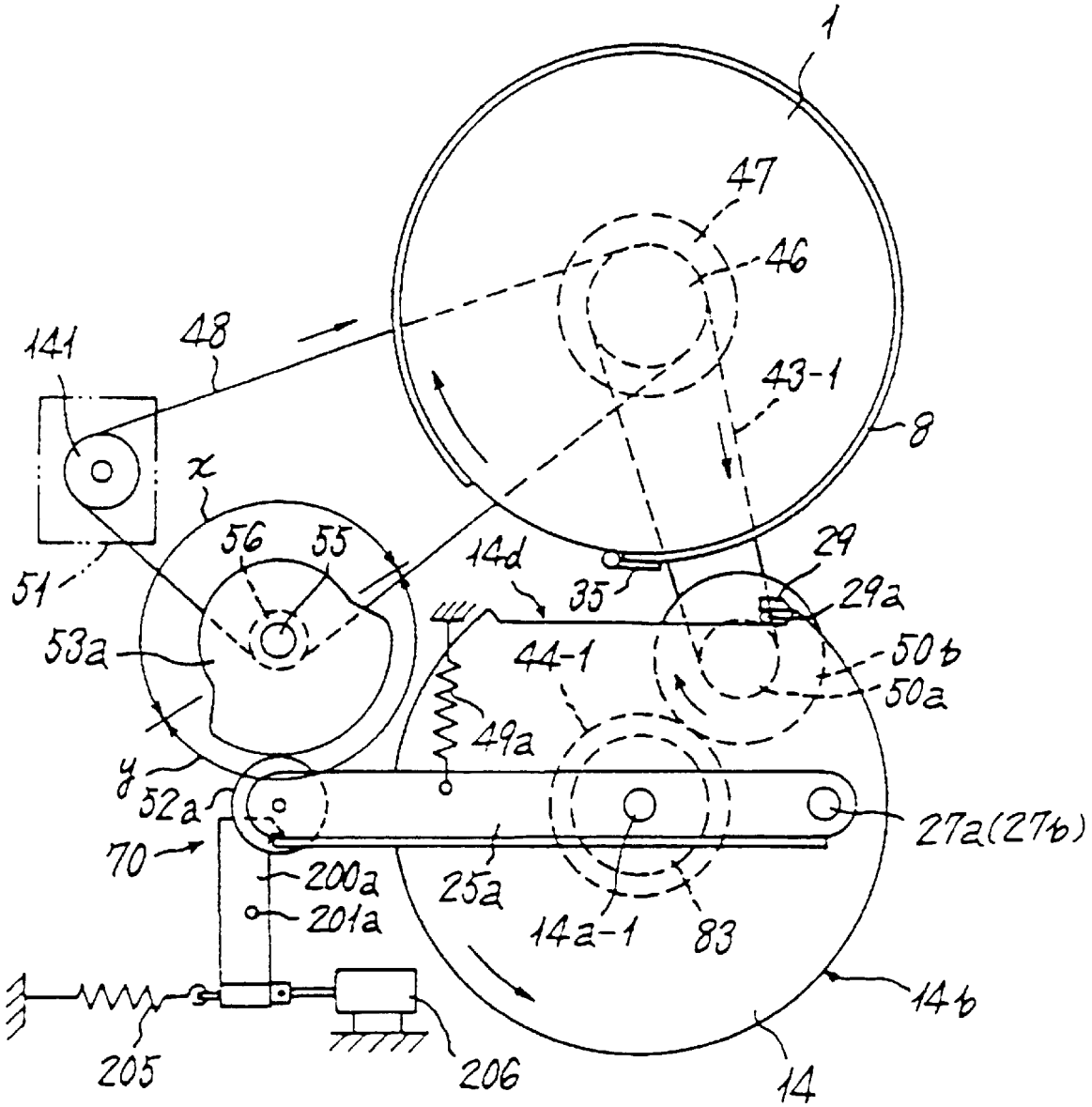
FIG. 6 shows a driveline for driving the press drum and an ink drum included in the embodiment.

Referring to FIGS. 5 and 6, a stencil printer embodying the present invention will be described. In FIGS. 5 and 6, the same structural elements as the elements shown in FIGS. 1 and 2 are designated by identical reference numerals, and a detailed description thereof will not be made in order to avoid redundancy. As shown in FIG. 6, a toothed pulley 50*a* is rotatably mounted on a stationary side wall 23*b* (see FIG. 5). An idle gear 50*b* is provided integrally with the pulley 50*a* in order to match the direction of rotation of a press drum 14 to that of the ink drum 1. The pulley 50*a* and a pulley 46 are connected together by a toothed belt 43-1. The gear 50*b* is held in mesh with a gear 44-1.

The gear 44-1 is mounted on a shaft 27*b*-1 within a box-like cover 30 affixed to the side wall 23*b*. One end of the shaft 27*b*-1 is rotatably supported by a bearing 45-1 mounted on the cover 30-1. The other end of the shaft 27*b*-1 is rotatably supported by a bearing 28-1 mounted on the side wall 23*b* and extends throughout the bearing 28-1 to the inside of the side wall 23*b*.

A shaft 14*a*-1 protruding from one end of the press roller 14 is supported by an arm 25*a* via a bearing 22*a*-1. In the illustrative embodiment, the shaft 14*a*- 1 extends throughout the bearing 22*a*-1 such that it is supported by the arm 25*a* even when the arm 25*a* is slid toward a side wall 23*a*. A shaft 14*a*-2 protruding from the other end of the press drum 14 is supported by an arm 25*b* via a bearing 22*a*-2. The shaft 14*a*-2, like the shaft 14*a*-1, extends throughout the arm 25*b* toward the side wall 23*b*.

The axis of the shaft 27*b*-1 extending to the inside of the side wall 23*b* and the axis of the shaft 14*a*-2 extending toward the side wall 23*b* align with each other at any desired angular position of the arm 25*b*.

In the illustrative embodiment, transmitting means for implementing smooth drive transmission from the shaft 27*b*-1 to the shaft 14*a*-2 is implemented by an Oldham coupling 83. Specifically, as shown in FIG. 7, the Oldham coupling 83 includes a guide flange 80 affixed to the shaft 14*a*-2, a guide flange 82 affixed to the shaft 27*b*-1, and a slider 81 intervening between the guide flanges 80 and 82.

Figure 7:
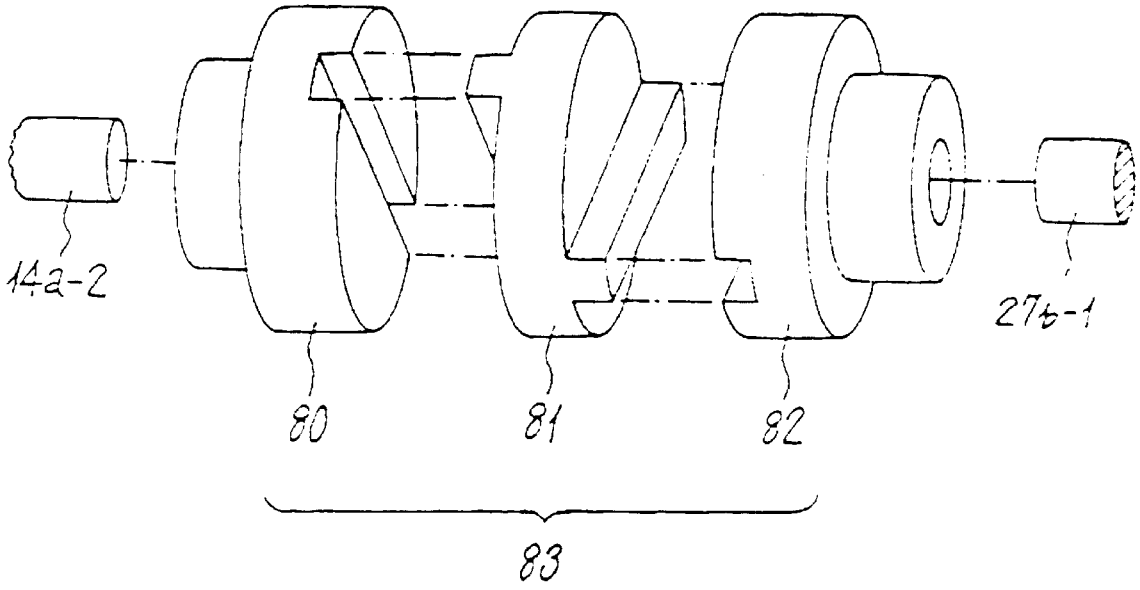
FIG. 7 is an exploded perspective view of an Oldham coupling implementing drive transmitting means in the embodiment.

As shown in FIGS. 5 and 7, the slider 81 is formed with rectangular projections on both sides thereof. The rectangular projections extend perpendicularly to each other and are slidably received in grooves formed in the guide flanges 80 and 82, respectively. In this configuration, even if the axes of the shafts 27*b*-1 and 14*a*-2 are brought out of alignment during rotation, the slider 91 slides relative to the guide flanges 80 and 82 when the shaft 27*b*-1 rotates. Because the slider 81 moves along an oval path, the rotation of the shaft 27*b*-1 is accurately transferred to the shaft 14*a*-2 without any change in speed.

Figure 8:
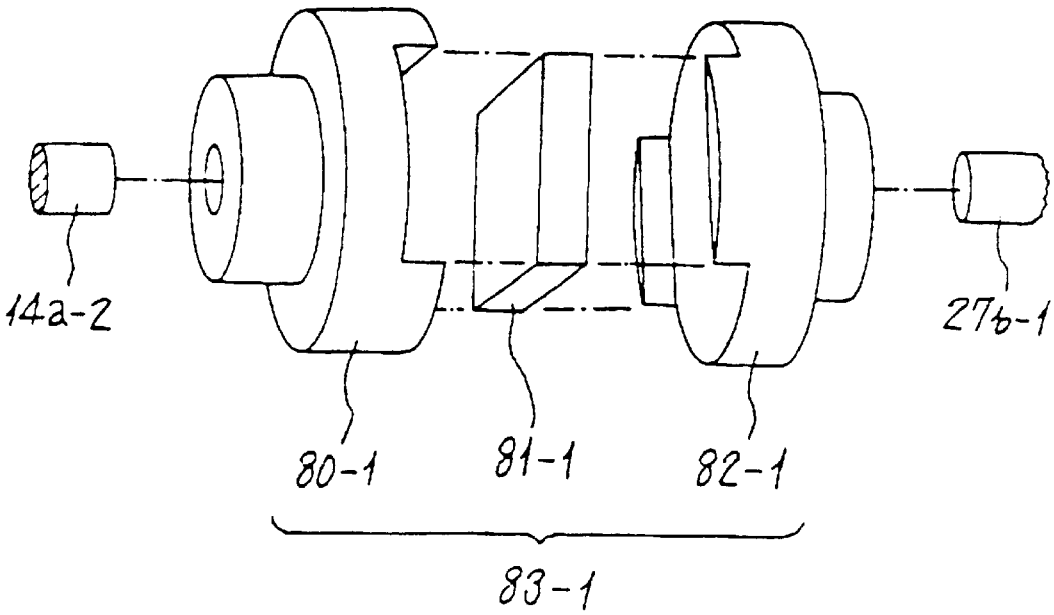
FIG. 8 is an exploded perspective view of an American coupling which is a modified form of the Oldham coupling.

FIG. 8 shows an American coupling 83-1 which is a modified form of the Oldham coupling 83. As shown, the American coupling 83-1 has a guide flange 80-1 affixed to the shaft 14*a*-2, a guide flange 82-1 affixed to the shaft 27*b*-1, and a slider 81-1 intervening between the guide flanges 80-1 and 82-1. The slider 81-1 is slidably received in recesses formed in the guide flanges 80-1 and 82-1. With this configuration, the American coupling 83-1 operate in the same manner as the Oldham coupling 83. Let the following description concentrate on the Oldham coupling 83 by way of example. While the Oldham coupling 83 may be replace with a universal coupling, the former is advantageous over the latter in that it needs only a minimum of space.

The advantage particular to the Oldham coupling 83 is that it prevents a speed from varying during drive transmission so long as the drive shaft 27*b*-1 and driven shaft 14*a*-2 are parallel to each other, i.e., even if the distance between their axes varies. Because the shaft 14*a*-2 angularly moves only about 1 mm to 3 mm during the angular movement of the arms 25*a* and 25*b*, the press drum 14 is free from critical changes in peripheral speed. A belt 48, pulleys 46 and 47, the belt 43-1, pulley 50*a* and gear 50*b* constitute a specific form of a driveline for driving the press drum 14. This kind of driveline is mounted on the side walls 23*a* and 23*b* or similar stationary members which will not be effected by the displacement of the press drum 14 toward or away from the ink drum 1 caused by moving means 70.

The easy mounting and dismounting of the press drum 14 achievable with the stencil printer using the Oldham coupling 83 will be described.

First, a case wherein the press drum 14 is dismounted by being moved in its axial direction and then moved perpendicularly to the axial direction will be described with reference to FIGS. 5 and 9–11. As shown in FIG. 5, the bearings 22*a*-1 and 22*a*-2 each has a larger diameter portion and a smaller diameter portion in a stepped configuration. Also, the shafts 14*a*-1 and 14*a*-2 each has a larger diameter portion and a smaller diameter portion in a stepped configuration. The bearing 22*a*-2 has its smaller diameter portion received in a hole formed in the arm 25*b* and has its shoulder abutting against the left end of the arm 25*b*. The shaft 14*a*-2 has its smaller diameter portion received in the bearing 22*a*-2 and has its shoulder abutting against the side end of the larger diameter portion of the bearing 22*a*-2.

The end face of the larger diameter portion of the bearing 22*a*-1 is abutted against the shoulder of the shaft 14*a*-1. The smaller diameter portion of the bearing 22*a*-1 is received in a hole formed in the arm 25*a* while the shoulder of the bearing 22*a*-1 is abutted against the right end of the arm 25*a*. In this condition, the recesses and rectangular projections of the Oldham coupling 83 are slidable on each other. An E ring or similar positioning means, not shown, positions the arm 25*a* in the axial direction of the shaft 27*a* in such a manner as to maintain the above assembled condition. This is also true with the arm 25*b* mounted on the shaft 27*b*.

Figure 9:
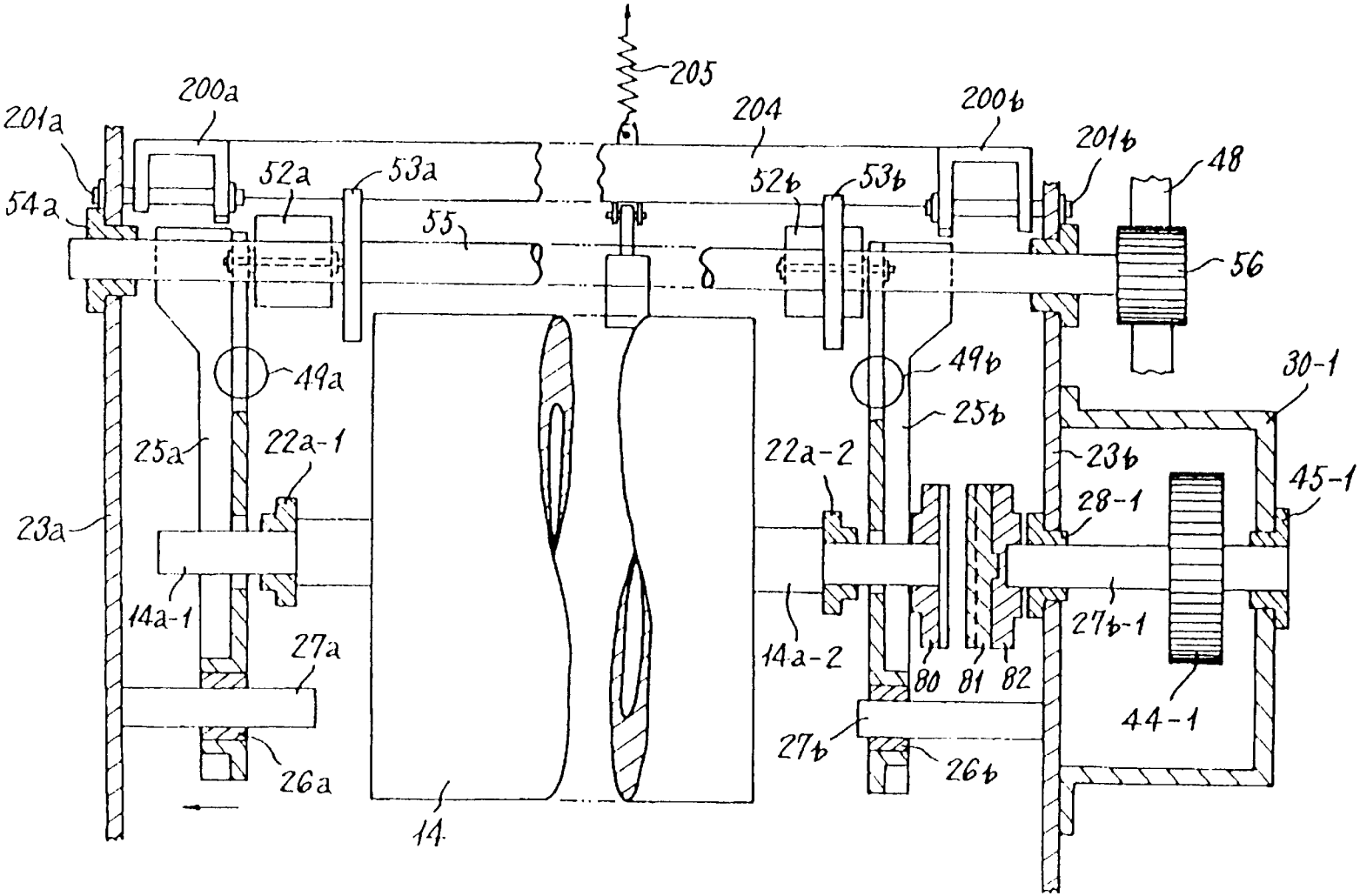
FIG. 9 is a section similar to FIG. 5, showing a part of structural members in their slid positions for allowing the press drum to be dismounted.

To dismount the press drum 14, the above E ring or similar positioning means positioning the arm 25*a* on the shaft 27*a* is removed. Then, the arm 25*a* is shifted toward the side wall 23*a* along the shaft 27*a*, i.e., to the left in FIG. 9. Subsequently, the press drum 14 is moved to the left in order to produce a space for moving the shaft 22*a*-2. Then, the bearing 22*a*-2 is removed from the arm 25*b*, as shown in FIG. 9. At the same time, the guide flange 80 is released from the slider 81.

Figure 10:
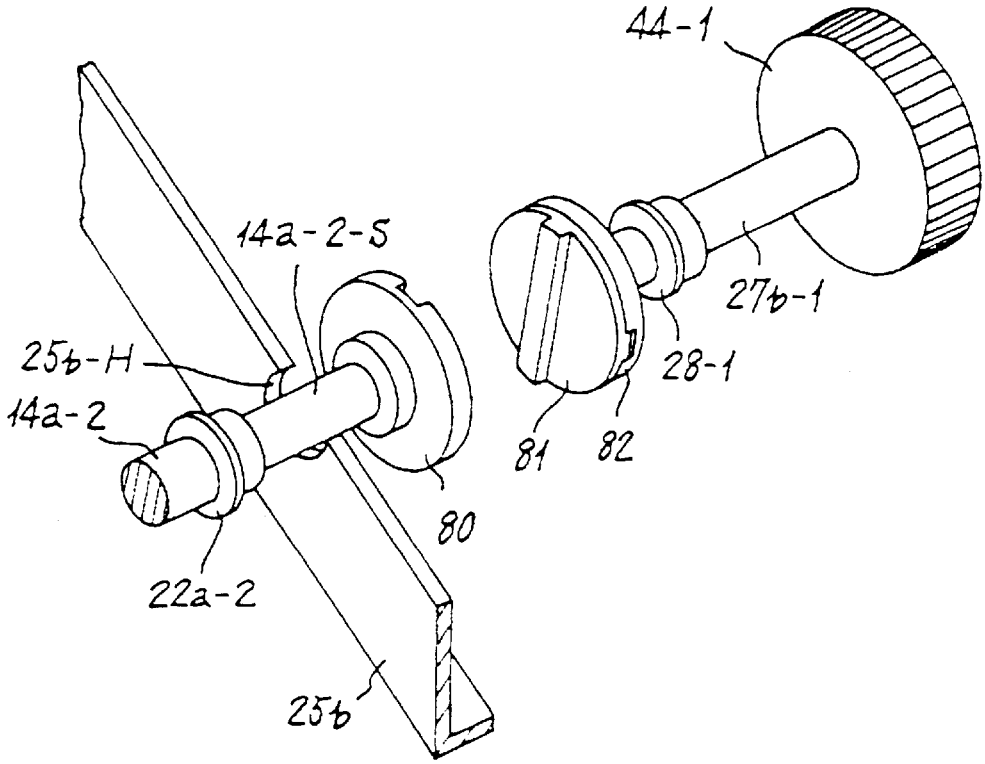
FIGS. 10 and 11 are perspective views respectively showing how arms and press drum shafts are engaged with each other at both ends of the press drum.
Figure 11:
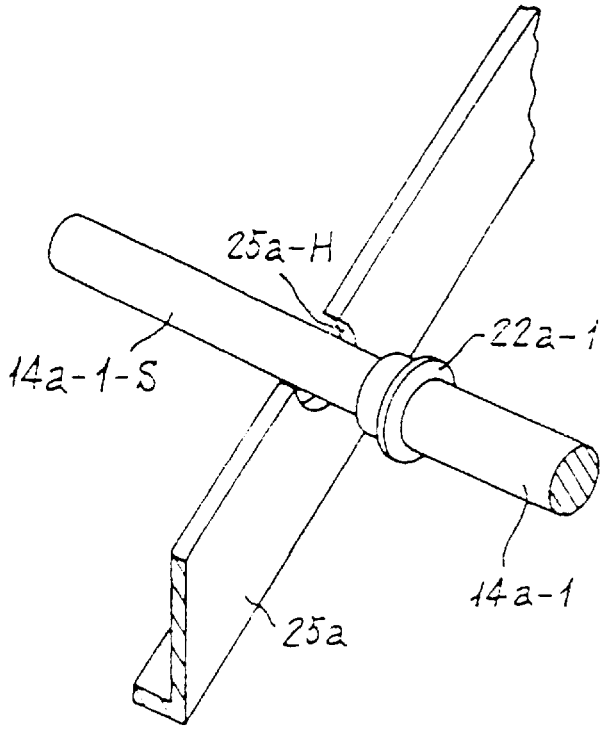

As shown in FIG. 10, the smaller diameter portion of the bearing 22*a*-2 is received in the hole, labeled 25*b*-H, of the arm 25*b*. The hole 25*b*-H is open at its top over a width allowing the smaller diameter portion, labeled 14*a*-2-S, of the shaft 14*a*-2 to pass therethrough. Likewise, as shown in FIG. 11, the smaller diameter portion of the bearing 22*a*-1 is received in the hole, labeled 25*a*-H, of the arm 25*a*. The hole 25*a*-H is open at its top over a width allowing the smaller diameter portion, labeled 14*a*-1-S, of the shaft 14*a*-1 to pass therethrough. Therefore, in the condition shown in FIGS. 9–11, it is possible to remove the press drum 14 from the printer in the direction perpendicular to the sheet surface of FIG. 9.

As for the guide flange 80 and slider 81, assume that the grooves and rectangular projections are formed symmetrically with respect to the centers of the guide flange 80 and slider 81. Then, it is likely that the guide flange 80 and slider 81 are put together in a position deviated by 180° from the expected position. In light of this, alignment marks may be provided on the guide flange 80 and slider 81 so as to allow them to b e assembled with accuracy. With these marks, it is possible to assemble the guide flange 80 and slider 81 without disturbing the relation between the clamping means 35 of the ink drum 1 and the catch 29 of the press drum 14.

When the above alignment marks are implemented as, e.g., simple flat lines, the operator may fail to recognize them by eye. To solve this problem, tridimensional limiting means easier to see than the flat marks may be provided on the guide flange 80 and slider 81 for allowing the operator to more surely recognize them and assemble the guide flange 80 and slider 81 without the 180° deviation.

Figure 12:
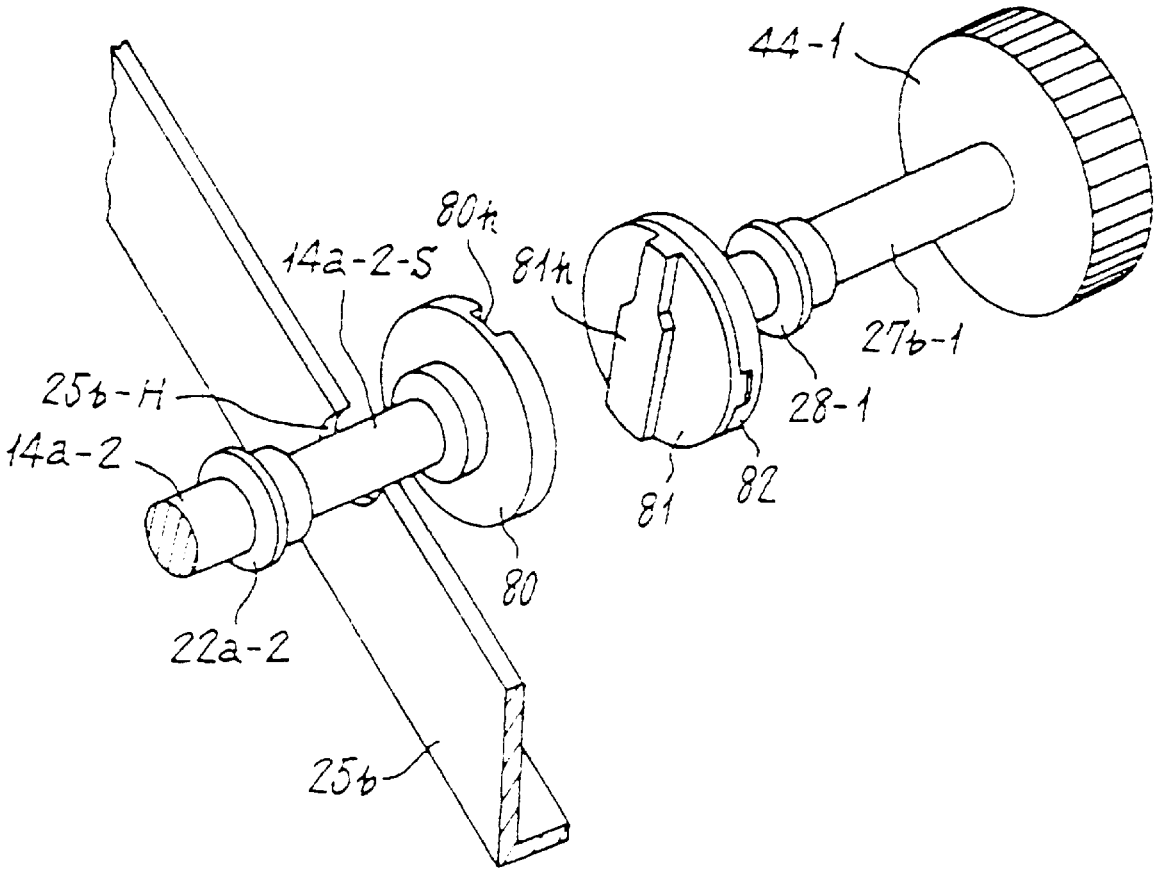
FIG. 12 is a perspective view showing the Oldham coupling provided with restricting means.
Figure 13:
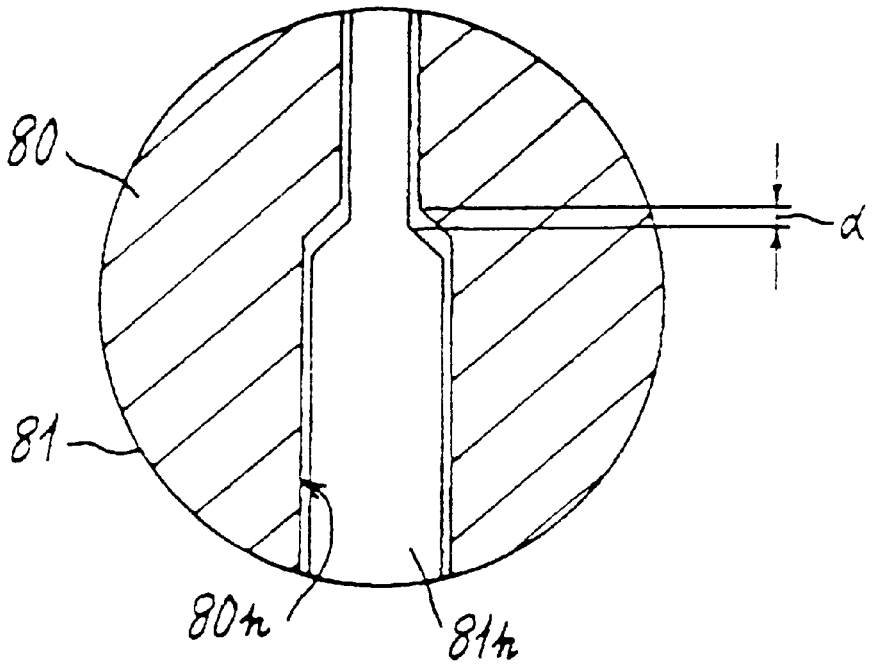
FIG. 13 shows the restricting means specifically.

In another specific configuration shown in FIGS. 12 and 13, the slider 81 is formed with rectangular projections 81*h* each having a larger width portion and a smaller width portion on its side facing the guide flange 80. The larger width portion and smaller width portion are contiguous with each other in the lengthwise direction of the respective projection 81*h* with the intermediary of a shoulder. However, the two portions of each projection 81*h* are identical in sectional shape in order to allow the slider 81 to slide. The guide flange 80 is formed with a groove 80*h* identical in configuration with the projection 81*h* and capable of receiving the projection 81*h*. When the slider 81 and guide flange 80 have their center aligned, a gap a exists between the shoulder of the projection 81*h* and the shoulder of the groove 80*h* in order to implement a preselected amount of slide.

Let the above combination of the rectangular projection 81*h* and groove 80*h* be referred to as restricting means. The restricting means asymmetrical with respect to the centers of the guide flange 80 and slider 81 plays the role of tridimensional alignment marks and can be surely recognized by eye. In addition, the restricting means allows the guide flange 80 and slider 81 to be assembled unconditionally in the preselected positional relation at all times. The sure recognition by eye obviates the 180° deviated assembly. Even if the recognition by eye is not correct, the projection 81h and recess 80 do not mate with each other and also obviate defective assembly.

Figure 14:
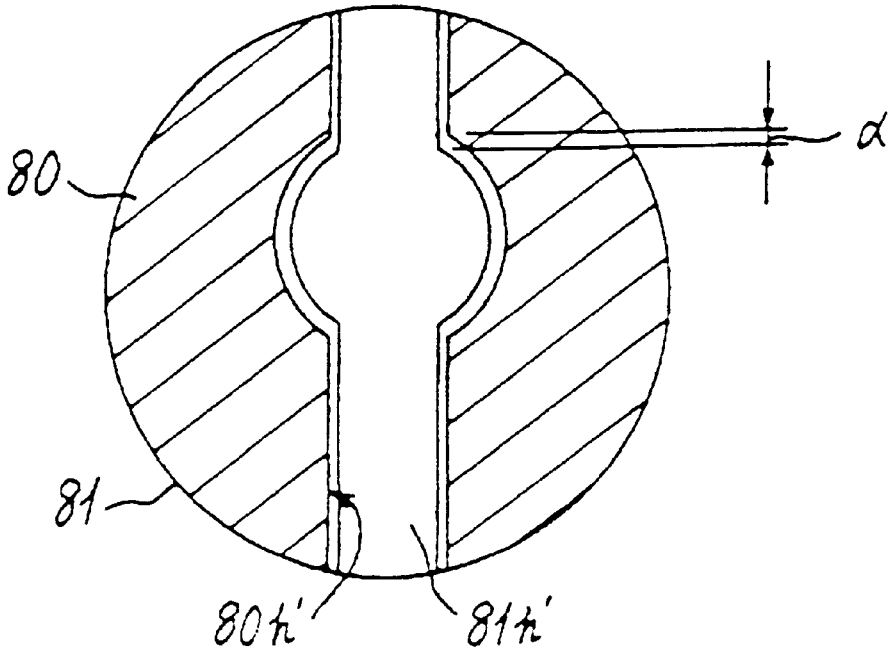
FIG. 14 shows another specific restricting means.

FIG. 14 shows another specific configuration of the restricting means. As shown, the restricting means is implemented as a rectangular projection 81*h*' and a groove 80*h*' receiving the projection 81*h*' therein. The projection 81*h*' and groove 80*h*' each has a circular bulging portion not aligning with the center of the slider 81 or that of the guide flange 80. The crux of this kind of restricting means is that it has a slidable Oldham coupling function and has an asymmetric configuration with respect to the centers of the slider 81 and guide flange 80.

When the arm 25*a* is moved to the left, as stated earlier, the roller 52*a* is also moved to the left and released from the cam 53*a*. As a result, the free end of the arm 25*a* is apt to rotate and fail to support the press drum 14 stably. In light of this, after the larger diameter portion y of the cam 53*a* has been caused to face the roller 52*a*, the solenoid 206 is deenergized so as to maintain the end of the arm 25*a* engaged with the hook lever 200*a*.

It is to be noted that the free end of the arm 25*a* is provided with a width great enough to maintain the above engagement over the stroke of the arm 25*a*. Therefore, even if the roller 52*a* is released from the cam 53*a* due to the movement of the arm 25*a*, the arm 25*a* is prevented from rotating. The groove of the guide flange 80 and the projection of the slider 81 have already been released from each other when the press drum 14 is moved to the left. It follows that the press drum 14 can be easily dismounted from the printer only if the arms 25*a* and 25*b* and the shafts 22*a*-1 and 22*a*-2 are disengaged from each other. The press drum can be easily mounted to the printer if the procedure described above is executed in the reverse order.

Next, a case wherein the press drum 14 is dismounted from the printer by being simply moved in the direction perpendicular to its axial direction will be described. The Oldham coupling 83 can be disassembled only if the groove of the guide flange and the projection of the slider 81 are shifted away from each other in the sliding direction. Therefore, if the restriction of the shafts 14*a*-1 and 14*a*-2 acting on the arms 25*a* and 25*b*, respectively, can be cancelled, it is possible to dismount the press drum 14 easily in the direction perpendicular to the axial direction without moving it in the axial direction.

Figure 15:
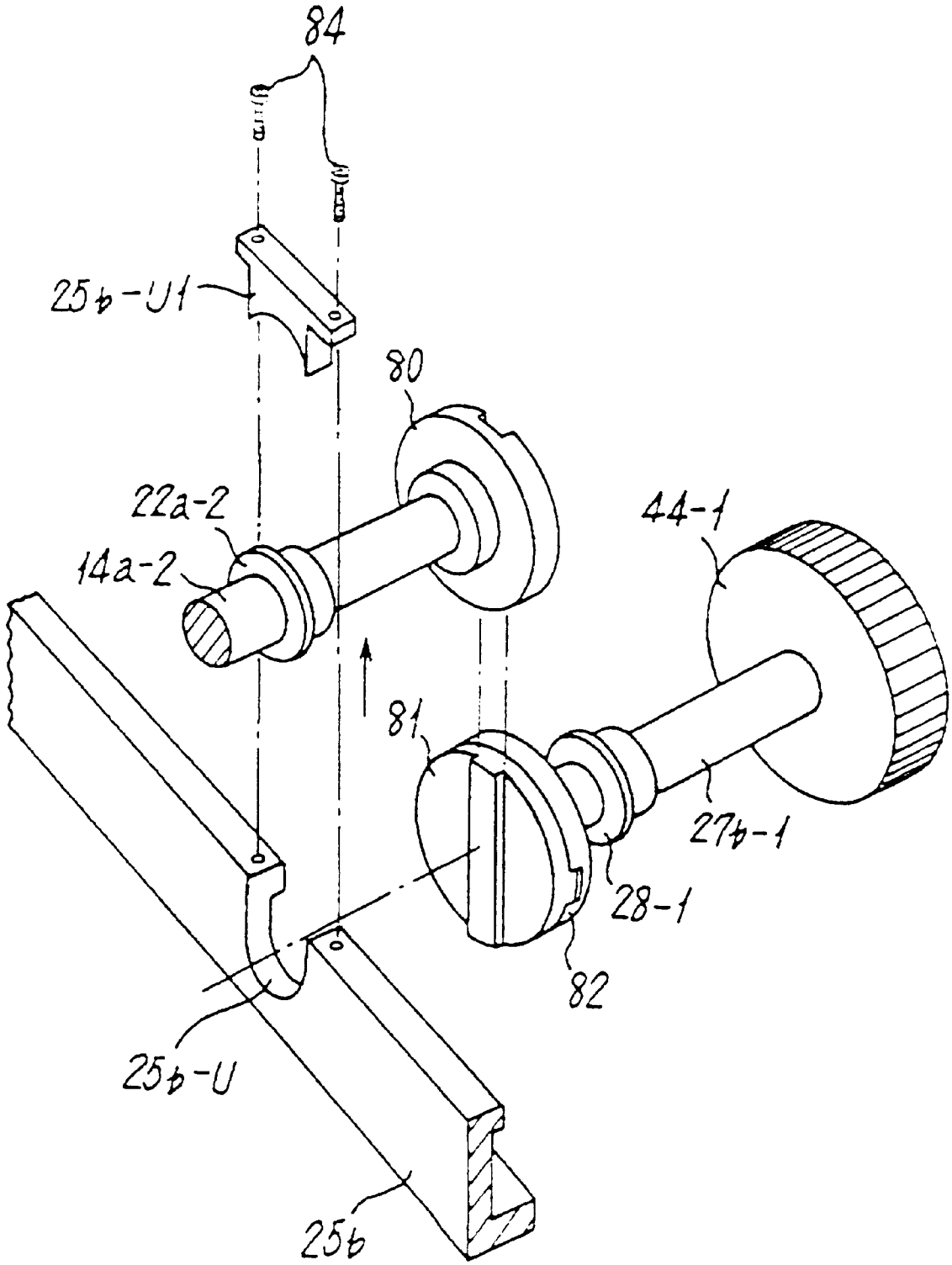
FIGS. 15 and 16 are perspective views showing another specific condition in which the arms and press drum shafts are engaged with each other at both ends of the press drum.
Figure 16:
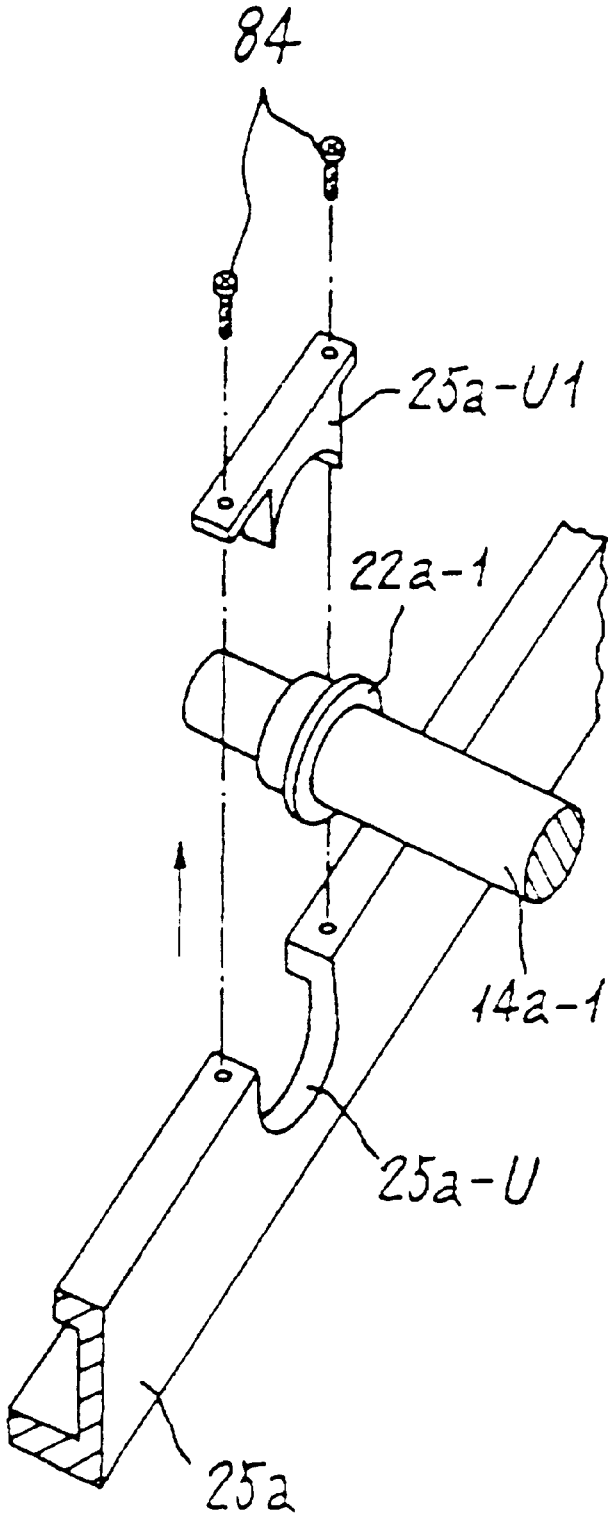

To cancel the restriction of the shafts 14*a*-1 and 14*a*-2 acting on the arms 25*a* and 25*b*, an arrangement is made such that the shafts 14*a*-1 and 14*a*-2 can be pulled out of the arms 25*a* and 25*b* together with the bearings 22*a*-1 and 22*a*-2, respectively, in the direction perpendicular to the axial direction. Specifically, as shown in FIG. 15, the arm 25*b* is formed with a generally U-shaped notch 25*b*-U. After the bearing 22*a*-2 has been positioned in the notch 25*b*-U, a cap 25*b*-U1 is positioned on the arm 25*b* over the bearing 22*a*-2. Then, the cap 25*b*-U1 is fastened to the arm 25*b* by screws 84. Likewise, as shown in FIG. 16, the arm 25*a* is formed with a generally U-shaped notch 25*a*-U. After the bearing 22*a*-1 has been positioned in the notch 25*a*-U, a cap 25*a*-U1 is positioned on the arm 25*a* over the bearing 22*a*-1. Then, the cap 25*a*-U1 is fastened to the arm 25*a* by screws 84.

In the above configuration, the press drum 14 can be easily dismounted from the printer only if the caps 25*a*-U1 and 25*b*-U1 are removed from the arms 25*a* and 25*b*, respectively. The press drum 14 can be easily mounted to the printer if such a procedure is executed in the reverse order.

In each of the above two different cases, the Oldham coupling 83 allows the press drum 14 to be pulled out upward, i.e., perpendicularly to the axial direction of the drum 14. Therefore, if the groove of the guide flange 80 and the projection of the slider 81 facing it are positioned in the above direction, the slider 81 is left on the guide flange 82 and pulled out together with the guide flange 82 because the other projection of the slider 81 is perpendicular to the projection facing the groove of the guide flange 80.

In a commercially available Oldham coupling, the guide flanges 80 and 82 and the slider 81 intervening between them are positioned with almost no clearance. In this condition, the conventional Oldham coupling is caused to slide for drive transmission.

In the printer to which the present invention is applicable, the press drum 14 is assumed to have an outside diameter of 180 mm to 220 mm and a weight of 2 kg to 3.5 kg and to be rotated at a speed of 120 rpm (revolutions per minute), i.e., two revolutions for a second. Further, the press drum 14 is moved into and out of contact with the ink drum 1 (twice for a second) in accordance with the angular movement of the arms 25*a* and 25*b*. When the Oldham coupling with almost no clearance is used for the drive transmission to the press drum 14 which is heavy and rotated at a high speed, frictional resistance at the clearance portion increases and brings about the defective operation of the guide flange 80 and shaft 14*a*-2. As a result, some difference occurs between the displacement of the arm 25*b* associated with the Oldham coupling and the displacement of the other arm 25*a*.

More specifically, when the rollers 52*a* and 52*b* respectively fall from the larger diameter portions to the smaller diameter portions of the cams 53*a* and 53*b*, the displacement of the arm 25*b* is short, compared to the displacement of the arm 25*a* That is, the side of the press drum 14 where the Oldham coupling is present, as viewed in the widthwise direction of the paper, does not follow the other side of the drum 14 where the coupling is absent. As a result, only the portion of the press drum 14 remote from the Oldham coupling presses the ink drum 1, causing an image to be partly lost at the side adjoining the coupling.

To solve the above problem, some clearance guaranteeing movement smooth enough to obviate the above local omission of an image, e.g., 0.01 mm to 0.05 mm must be provided between each of the guide flanges 80 and 82 and the slider 81.

However, the above clearance is problematic, considering the fact that the press drum 14 must be removable from the printer at the time of maintenance. Assume that the press drum 14 is released from the slider 81 together with the shaft 14*a*-2 and guide flange 80. Then, the slider 81 is apt to slip out of the guide flange 82 and drop because the engagement between the projection of the slider 81 and the groove of the guide flange 82 is loose due to such a clearance. This makes the mounting and dismounting operation troublesome.

Figure 17:
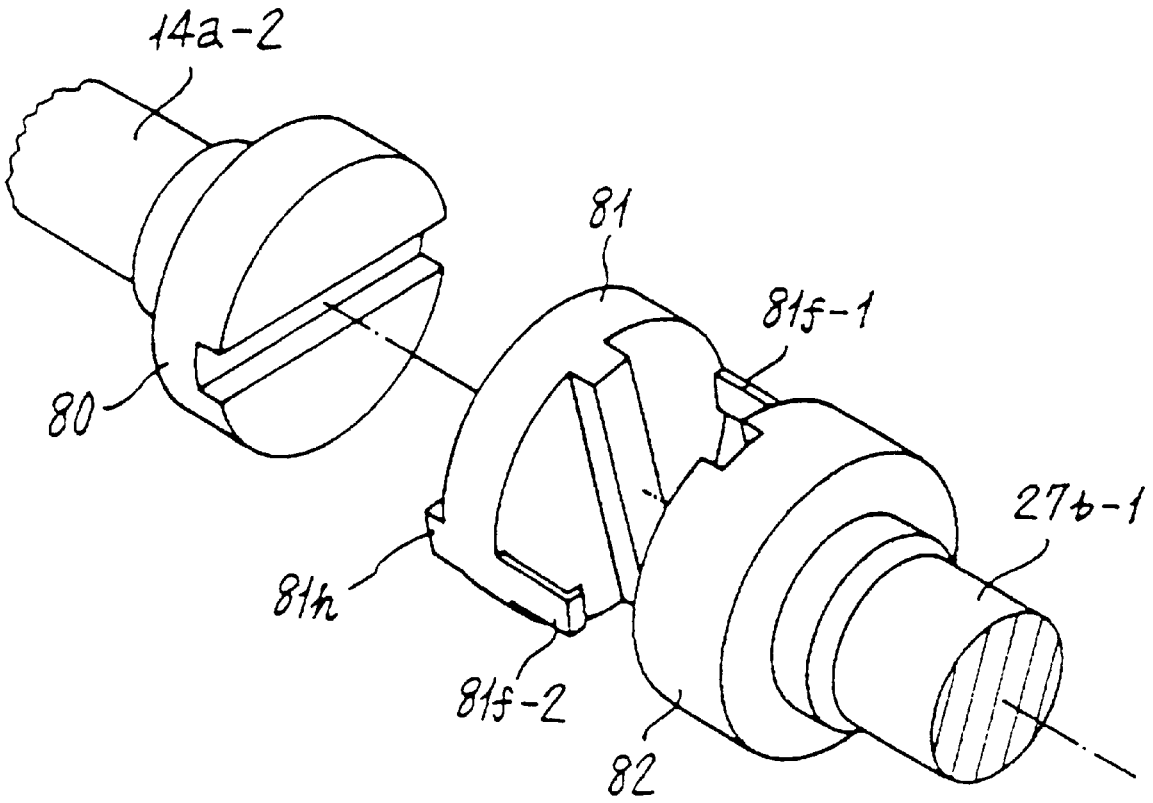
FIG. 17 shows locking hooks.

In the illustrative embodiment, as shown in FIG. 17, the slider 81 is formed with hooks 81*f*-1 and 81*f*-2 so as to be prevented from easily slipping out of the guide flange 82. The hooks 81*f*-1 and 81*f*-2 lock the slider 81 to the guide flange or drive guide flange 82. The hooks 81*f*-1 and 81*f*-2 face each other in the diametral direction of the slider 81, and each is implemented as a flat elastic member. The hooks 81*f*-1 and 81*f*-2 extend from the periphery of and in the axial direction of the slider 81, but at positions deviated from the projection so as not to interfere with the sliding movement.

The distance between the hooks 81*f*-1 and 81*f*-2 is equal to the sum of the diameter of the guide flange 82, the angular displacement of 1 mm to 3 mm of the press drum 14, and a clearance of 1 mm to 2 mm preventing the hooks 81*f*-1 and 81*f*-2 from contacting the circumference of the guide flange 82. The hooks 81*f*-1 and 81*f*-2 each has a length reaching the other side of the guide flange 82 where the groove is absent. The free end of each hook 81*f*-1 or 81*f*-2 is bent, as illustrated. To assemble the Oldham coupling, the operator forces the elastic hooks 81*f*-1 and 81*f*-2 away from each other and then releases them when the bent ends of the hooks 81*f*-1 and 81*f*-2 embrace the guide flange 82. As a result, the bent ends catch the guide flange 82 and lock the slider 81 to the guide flange 82.

The hooks 81*f*-1 and 81*f*-2 successfully prevent the slider 81 from slipping out of the guide flange 82 when the press drum 14 is mounted or dismounted. However, in the specific configuration shown in FIG. 17, when the lengthwise direction of the projection of the slider 81 coincides with the direction of gravity, the slider 81 may drop because the hooks 81*f*-1 and 81*f*-2 do not play the role of a stop in the above direction. In light of this, at the time of mounting or dismounting, the Oldham coupling should preferably be stopped at an angular position where either one of the hooks 81*f*-1 and 81*f*-2 is located at the bottom.

Assume that the projection and groove have the stepped shapes shown in FIG. 13, and that the Oldham coupling is stopped at an angular position where the smaller width portion of the projection is located at the bottom. Then, the shoulders of the projection and groove prevent the slider 81 from dropping; the stop position of the coupling does not depend on the positions of the hooks 81*f*-1 and 81*f*-2. Further, the configuration shown in FIG. 14 is capable of preventing the slider 81 from dropping at any angular position of the Oldham coupling due to the bulging portions.

While two hooks 81*f*-1 and 81*f*-2 are shown in FIG. 17, three or more hooks may be used in order to free the Oldham coupling from the limitation on its stop position. If desired, only one hook may be provided so long as the stop position of the Oldham coupling is limited for the prevention of the drop of the slider 81, as stated above.

The present invention is applicable to both of a stencil printer of the type having ink feeding means inside of an ink drum and a stencil printer of the type having it outside of an ink drum. Printing processes particular to such two different types of stencil printers will be briefly described hereinafter.

First, the printer of the type having ink feeding means inside an ink drum will be described with reference to FIG. 18. As shown, the ink drum 1 includes a porous hollow cylindrical body having a porous portion 1*b*. A mesh screen is wrapped around the porous body. The clamping means 35 includes a rotatable damper provided on the ink drum 1 and extending in the axial direction of the drum 1. Opening/closing means, not shown, causes the clamping means 35 to selectively open or close at a preselected position.

Figure 18:
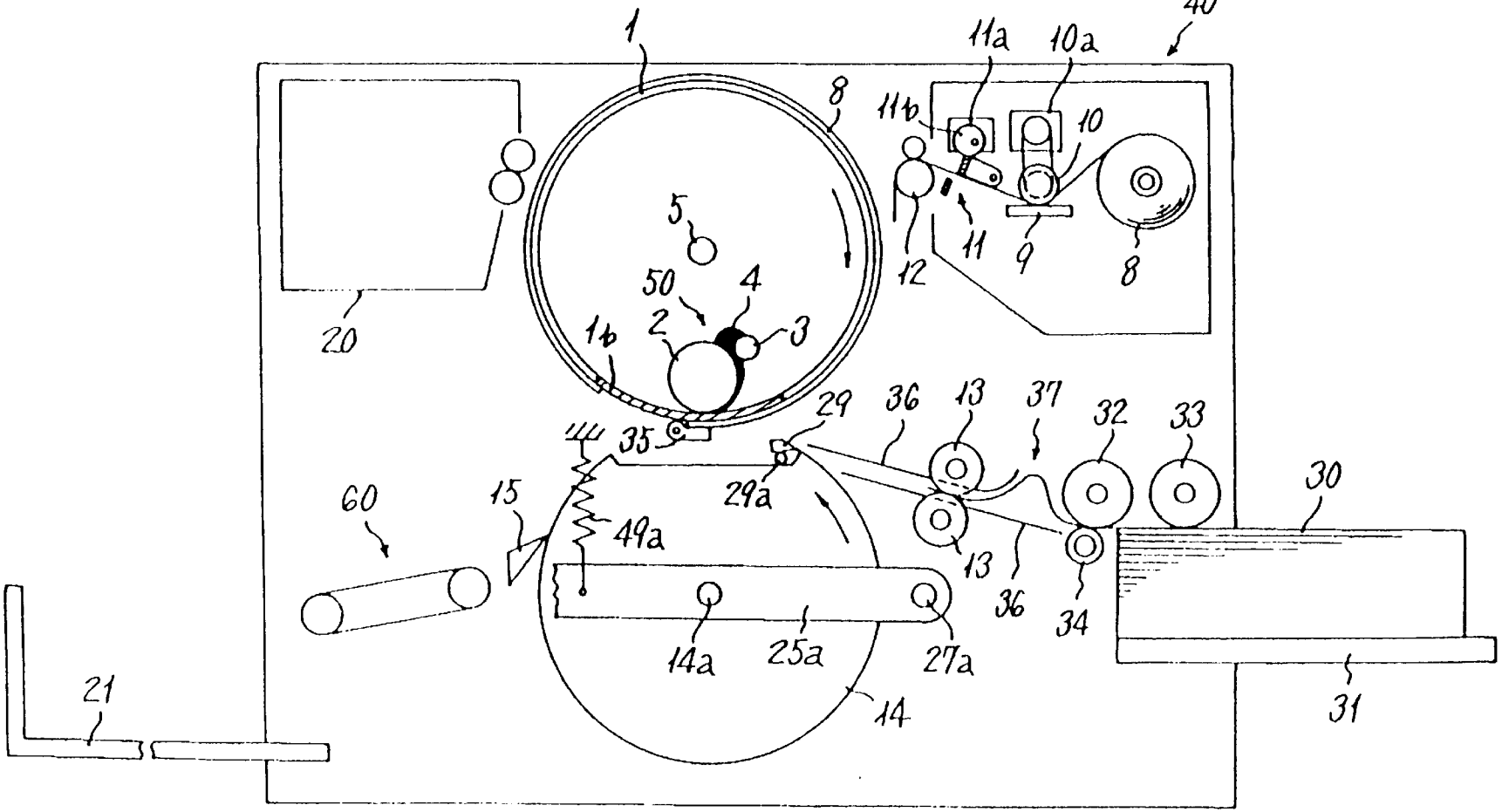
FIGS. 18 and 19 each shows a particular type of stencil printer to which the present invention is advantageously applicable.

A master making device 40 is located at the right of the ink drum 1, as viewed in FIG. 18, and includes a thermal head 9. A stencil or master 8 perforated, or cut, by the thermal head 9 in accordance with document data is fed toward and wrapped around the ink drum 1. Specifically, after the clamping means 35 has clamped the leading edge of the master 8, the master 8 is sequentially wrapped around the ink drum 1 due to the rotation of the drum 1.

The master making device 40 has, in addition to the thermal head 9, a platen roller 10, a cutter 11, and a master feed roller 12. The platen roller 10 presses the stencil 8 against the head 9 while conveying the stencil 8. The cutter 11 cuts the stencil 8 at a preselected length to thereby produce a master (also designated by the reference numeral 8 hereinafter). The master feed roller 12 guides the leading edge of the master 8 to the clamping means 35.

The head 9 perforates the stencil 8 in accordance with an image signal received from a scanner, not shown. The perforated stencil 8 has its leading edge clamped by the clamping means 35 held open at a preselected position. Then, the drum 1 starts rotating in the direction indicated by an arrow in FIG. 18, sequentially wrapping the stencil 8 therearound. The amount of feed of the stencil 8 is controlled by a pulse motor 10*a* via the platen roller 10. When the stencil 8 is fed by a preselected amount, a cutter motor 11*a* rotates an eccentric cam 11*b* and thereby moves the cutter 11. As a result, the cutter 11 cuts off the master 8 at a preselected length. The cut stencil or master 8 is fully wrapped around the ink drum 1, as stated above.

A master discharging device 20 is arranged at the left of the ink drum 1 for peeling off a used master from the ink drum 1 and collecting it. After the new master 8 has been fully wrapped around the ink drum 1, the drum 1 is caused to rotate clockwise by the motor 51, FIG. 6, or similar drive source. An ink roller 2 and a doctor roller 3 are disposed in the ink drum 1 and slightly spaced from each other. The i n k roller 2 is rotatable in synchronism with and in the same direction as the ink drum 1. The ink roller 2 and doctor roller 3 form a wedge-shaped ink well 50 therebetween. Ink 4 is fed from the ink well 50 to the periphery of the ink roller 2.

Specifically, the ink 4 is fed to the ink well 50 through openings formed in a tubular shaft 5. The ink is transferred from the ink roller 2 to the inner periphery of the ink drum 1 via a small gap between the inner periphery of the drum 1 and the outer periphery of the ink roller 2. The press roller 14 is supported by the shaft 14*a* which is supported by the arm 25*a*. The arm 25*a* is angularly movable about the shaft or fulcrum 27*a*. The press drum 14 is movable into and out of contact with the ink drum 1 in accordance with the angular movement of the arm 25*a*. The press drum 14 is provided with substantially the same diameter as the ink drum 1 and rotated at a such a ratio that it contacts the press drum 1 at the same position for every rotation. The press drum 14 is rotated counterclockwise, as viewed in FIG. 18.

The press drum 14 has a generally D-shaped configuration so as not to collide with the clamping means 35 of the ink drum 1. Specifically, a part of the circumference of the press drum 14 is removed in the form of a flat portion. The catch 29 is rotatably mounted on a shaft 29*a* in the flat portion in order to catch the leading edge of the paper 30. A cam, not shown, causes the catch 29 to open and catch the the paper 30 at a preselected timing, and then causes it to close for thereby retaining the paper 30 on the press drum 14. When the catch 29 arrives at the peeler 15, the cam again causes the catch 29 to open and release the paper 30. The paper 30 released from the catch 29 is fed to a conveying device 60. The cams 53*a* and 53*b*, FIGS. 5 and 6, rotating in synchronism with the ink drum 1 release the press drum 14 from the ink drum 1 at a preselected timing in order to cope with the misfeed of the paper 30 and to prevent the drum 14 from contacting the drum 1 during master making operation.

When misfeed does not occur, the press drum 14 with the paper 30 is again pressed against the ink drum 1 by the springs 49*a* and 49*b*. In the event of misfeed, the cams 53*a* and 53*b* are so controlled as to prevent the press drum 14 from contacting the ink drum 1. After the ink has been transferred to the paper 30, the catch 29 is opened to release the leading edge of the paper 30. The peeler 15 peels off the paper 30 from the press drum 14. As a result, the paper 30 is driven out of the printer to a tray 21 by the conveying device 60.

An elevatable paper tray 31 and a paper feeding device are positioned below and at the right of the ink drum 1. The paper tray 31 is loaded with a stack of papers 30. A drive arrangement, not shown, causes the paper tray 31 to move up or down with the top of the stack 30 contacting the pick-up roller 33 with an adequate range of pressure (range allowing the top paper 30 to be conveyed).

The paper feeding device has a feed roller 32 in addition to the pick-up roller 33. An endless belt, not shown, is passed over the two rollers 32 and 33 in order to allow them to rotate in synchronism with each other. A separator roller 34 is positioned beneath the feed roller 32 for preventing two or more papers 30 from being fed together. A pair of registration rollers 13 and a pair of guide plates 36 are positioned downstream of the rollers 32 and 34 in the direction of paper feed. The guide plates 36 guide the paper 30 to the nip between the registration rollers 13.

The feed roller 32 is rotated clockwise by a cam rotatable in synchronism with the ink drum 1 and a feed roller gear engaged with the cam and having a sector gear and a one-way clutch built therein, although not shown specifically. The lower registration roller 13 is rotated counterclockwise by a cam rotatable in synchronism with the ink drum 1 and a registration roller gear engaged with the cam and having a sector gear and a one-way clutch built therein, although not shown specifically. The registration roller pair 13 feeds the paper 30 at a speed equal to the peripheral speed of the ink drum 1.

The conveyance of the paper 30 will be described more specifically hereinafter. In FIG. 18, the paper 30 paid out from the top of the stack on the tray 31 by the pick-up roller 33 and feed roller 32 is separated from the underlying papers by the feed roller 32 and separator roller 34. The leading edge of the paper 33 abuts against the nip between the registration rollers 13 which are held in a halt at this stage of conveyance. As the paper 30 is further fed, it warps upward to form a preselected amount of loop 37. Then, the pick-up roller 33 and feed roller 32 are brought to a stop.

Subsequently, the registration roller pair 13 is caused to rotate by the previously mentioned cam. As a result, the paper 30 is fed toward the press drum 14 with its loop 37 sequentially decreasing. At this instant, the pick-up roller 33 and feed roller 32 including the one-way clutch are rotated, following the movement of the paper 30. The catch 29 of the press drum 14 is opened in synchronism with the conveyance of the paper 30 and is closed on nipping the leading edge of the paper 30. The press drum 14 is rotated so as to convey the paper 30 retained thereon toward the nip between the ink drum 1 and the press drum 14.

Because the nip between the ink drum 1 and the press drum 14 is constantly biased by the tension springs 49*a* and 49*b*, the drum 14 presses the paper 30 against the drum 1. At this instant, the ink 4 passed through the perforations of the master 8 is transferred to the paper 30. As soon as the catch 29 on the press drum 14 is brought to a position short of the peeler 15, the catch 29 is opened to release the paper 30 to which the ink 4 has been transferred. As a result, the paper 30 gets on the peeler 15 and is sequentially peeled off thereby. The paper 30 peeled off from the press drum 14 is driven out of the printer by the conveying device 60 and stacked on the tray 21.

Secondly, the stencil printer of the type having ink feeding means outside of an ink drum will be described with reference to FIG. 19. As shown, the printer includes an ink drum 1-1 implemented as a hollow cylindrical member whose surface does not have any pore. The ink drum 1-1 is rotatable in the direction indicated by an arrow during printing, but in the opposite direction during master discharging.

The surface of the ink drum 1-1 includes a bottomed recess 1-1B. A master is wrapped around the ink drum 1-1 except for the bottomed recess 1-1B. The recess 1-1B includes a flat surface on which a damper 1-1C for clamping the leading edge of a master is positioned. The part of the master other than the leading edge adheres to the periphery of the ink drum 1-1 due to the adhesive force of ink fed to the print drum 1-1 by an ink feeding mechanism or means which will be described.

Figure 19:
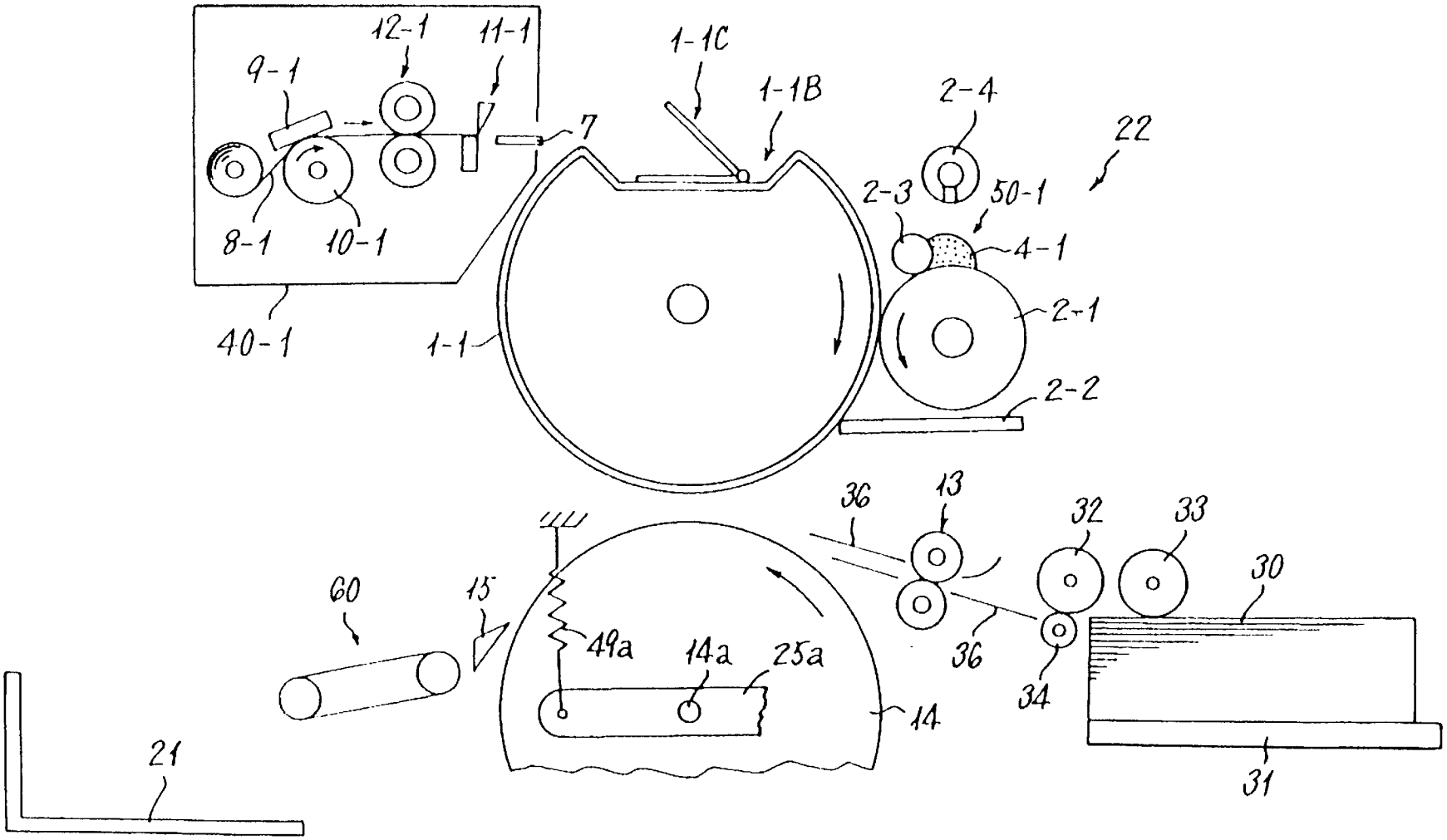

A master making device 40-1, the ink feeding mechanism and the press drum 14 are sequentially arranged around the ink drum 1-1 in the direction of rotation of the drum 1-1 indicated by the arrow in FIG. 19. In FIG. 19, the press drum 14 and members associated therewith, pick-up roller or paper feeding means 33, paper tray 31, feed roller 32, registration roller pair 13, separator roller 34, guide plates 36, peeler 15, conveying device 60 and tray 21 are constructed and arranged in the same manner as in FIG. 18 and will not be described specifically in order to avoid redundancy.

The master making device 40-1 perforates a stencil 8-1 paid out from a roll in accordance with an image signal, thereby making a master. The device 40-1 includes a thermal head 9-1, a platen roller 10-1, a conveyor roller pair 12-1, a cutter 11-1, and a master guide 7.

The stencil 8-1 consists of a 1 $\mu$m to 2 $\mu$m thick film of polyester or similar thermoplastic resin and a porous substrate laminated to the film. The porous substrate is formed of a porous elastic material. The stencil 8-1 paid out from the roll is pressed against the thermal head 9-1 by the platen roller 10-1. Heating elements arranged on the head 9-1 are selectively energized in accordance with an image signal so as to form perforations in the stencil 8-1 over a range extending in the main and subscanning directions. Specifically, a head control section, not shown, selectively feeds current to the heating elements by use of a drive signal. As a result, particular ones of the heating elements selected in the main scanning direction generate heat and perforate the stencil 8-1.

A stepping motor or similar drive source, not shown, causes the platen roller 10-1 to rotate stepwise and feed the stencil 8-1 in the subscanning direction. The conveyor roller pair 12-1 located downstream of the platen roller 9-1 in the direction of stencil feed is also connected to the above stepping motor via a torque limiter. The roller pair 12-1 conveys the stencil 8-1 at a speed slightly higher than the speed at which the platen roller 10-1 conveys the stencil 8-1. This prevents the stencil 8-1 from slackening or creasing. The perforated part of the stencil 8-1 is cut by the cutter 11-1 at a preselected length to turn out a master (also designated by the reference numeral 8-1 hereinafter). The master 8-1 is fed in the direction tangential to the ink drum 1-1 and has its leading edge clamped by the damper 1-1C.

The ink feeding mechanism 22 is movable into and out of contact with the periphery of the ink drum 1-1. The major constituents of the mechanism 22 are an ink roller 2-1 capable of contacting the ink drum 1-1, a blade 2-2, and a doctor roller 2-3 slightly spaced from the ink roller 2-1. The ink roller 2-1 is formed of metal and positioned below an ink feed pipe 2-4. Drive transmitting means including gears and a belt, not shown, causes the ink roller 2-1 to rotate at a speed synchronous with the peripheral speed of the press drum 1-1. Ink is deposited on the ink roller 2-1 in a thin uniform layer by being regulated by the doctor roller 2-3. The ink roller 2-1 with the ink is brought into contact the master 8-1 wrapped around the ink drum 1-1, so that the ink is transferred from the ink roller 2-1 to the master 8-1.

The amount of ink to deposit on the ink roller 2-1 and determined by the gap between the roller 2-1 and the doctor roller 2-3 is selected to be the sum of an amount capable of filling up the space including the gap between the ink drum 1-1 and the master 8-1 and the perforations of the master 8-1, and some margin. The amount capable of filling the above space is selected to be great enough to print an image on a single paper. The ink roller 2-1 and doctor roller 2-3 forms a wedge-like ink well 50-1 therebetween. Ink 4-1 dropping from openings formed in the ink feed pipe 2-4 gathers in the ink well 50-1.

The blade 2-2 removes the ink fed from the outside of the master 8-1, but deposited on portions other than the perforated portion of the master 8-1. The portions other than the perforated portion mainly refer to the surface of the master 8-1. When the ink is removed from the surface of the master 8-1, the ink fed from the ink roller 2-1 fills only the perforations of the master 8-1 and the gap between the ink drum 1-1 and the master 8-1 facing it.

At the time of printing, the stencil 8-1 perforated b y heat at the nip between the head 9-1 and the platen roller 10-1 is conveyed toward the ink drum 1-1 in accordance with the amount of rotation of the platen roller 10-1. As soon as the leading edge of the stencil 8-1 arrives as the damper 1-1C, the damper 1-1C clamps it and retains it on the ink drum 1-1.

The ink drum 1-1 starts rotating when the damper 1-1C clamps the leading edge of the stencil 8-1. After the stencil 8-1 has been fed by a preselected length, it is cut off by the cutter 11-1 to turn out the master 8-1. Before the damper 1-1C clamps the leading edge of the stencil 8-1, the ink roller 2-1 applies the ink uniformly to the ink drum 1-1 and thereby allows the part of the stencil 8-1 other than the leading edge to adhere to the ink drum 1-1. This prevents the master 8-1 wrapped around the drum ink 1-1 from being dislocated during printing. After the master 8-1 has been wrapped around the ink drum 1-1, the drum 1-1 is caused to stop rotating. This is followed by a printing operation.

During printing, the ink roller 2-1 is brought into contact with the master 8-1 retained on the ink drum 1-1 while the ink is fed from the ink feed pipe 2-4. The ink gathering in the ink well 50-1 forms a thin layer on the ink roller 2-1 by being regulated in amount by the doctor roller 2-3. The ink is transferred from the ink roller 2-1 to the space mentioned earlier by way of the perforations of the master 8-1.

The ink fed from the ink roller 2-1 to the surface of the master 8-1, but not forced into the space mentioned earlier, is left on the part of the master 8-1 moved away from the roller 2-1. The blade 2-2 removes this part of the ink from the master 8-1. The ink removed by the blade 2-2 is returned to the ink well 50-1 via a gap between the ink roller 2-1 and the blade 2-2.

After the ink has been fed to the master 8-1 by the above procedure, the paper 30 fed from the registration roller pair 13 is conveyed toward the catch 29 (not shown in FIG. 19) of the press drum 14 which has started rotating in such a manner as to meet the ink transfer area of the master 8-1. At this instant, the press drum 14 is held in the position spaced from the ink drum 1-1. The paper 30 is wrapped around the press drum 14 with its leading edge retained by the catch 29.

When the press drum 14 is brought into contact with the ink drum 1-1 in synchronism with the rotation of the drum 1-1 by the angular movement of the arms 25*a* and 25*b*, the paper 30 is pressed against the master 8-1 by the press drum 14. As a result, the porous substrate of the stencil 8-1 is contracted, and therefore the space mentioned earlier decreases. This causes the ink filling the above space to move outward via the perforations of the master 8-1. Consequently, the ink is transferred to the paper 30 and forms an image thereon.

When the paper 30 begins to leave the position where it faces the press drum 14, the pressure of the press drum 14 is cancelled with the result that the porous substrate of the master 8-1 begins to expand to its original thickness. Consequently, the space mentioned earlier is depressurized and sucks an excessive part of the ink from the paper 30. Before the catch 29 of the press drum 14 reaches the position short of the peeler 15, it is opened so as to release the leading edge of the paper 30 carrying the ink thereon. The paper 30 gets on the peeler 15 and is conveyed toward the tray 21 by the conveying means 60 while being sequentially peeled off from the press drum 14.

In summary, it will be seen that the present invention provides a stencil printer having various unprecedented advantages, as enumerated below.

(1) Despite that a press drum is displaced by moving means, it can rotate at a constant speed and can therefore surely catch a paper and retain it thereon.

(2) Drive transfer to the press drum is implemented by an Oldham coupling. Because the Oldham coupling has grooves and rectangular projections simply engaged with each other, it can be easily assembled and disassembled at the time of maintenance. This allows the press drum to be easily mounted and dismounted from the printer. In addition, the press drum can be accurately positioned relative to an ink drum with ease because the position in which the grooves and projections of the Oldham coupling mate is easy to specify.

(3) Hooks prevent a slider included in the Oldham coupling from slipping out of a slider also included in the coupling, further enhancing easy mounting and dismounting of the press drum.

(4) Restricting means is easy to recognize by eye and defines an unconditional engaging position of the slider and guide flange. This promotes accurate assembly of the press drum.

Various modifications will become possible for those skilled in the art after receiving the teachings of the present disclosure without departing from the scope thereof.

What is claimed is:

1. A stencil printer comprising:

a cylindrical ink drum including ink feeding means and rotatable with a perforated master wrapped around a periphery thereof;

recording medium feeding means for feeding a recording medium;

a cylindrical press drum for retaining the recording medium fed from the recording medium feeding means on a periphery thereof, and rotatable in a direction opposite to a direction of rotation of said ink drum while pressing the recording medium against said ink drum;

moving means for selectively moving said press drum into or out of contact with said ink drum in synchronism with a feed of the recording medium to thereby prevent said press drum from contacting said ink drum when the recording medium is absent between said press drum and said ink drum; and an Oldham coupling connecting said press drum and a press drum driveline arranged on stationary members which are not influenced by a displacement of said press drum caused by said moving means, said Oldham coupling causing, during and before and after the displacement of said press drum, said press drum to rotate smoothly in accordance with a rotation of said press drum driveline without any variation in speed despite the displacement of said press drum, wherein said Oldham coupling includes a slider and two guide flanges, the clearance between the slider and the two guide flanges being at least 0.01 mm.

2. A stencil printer as claimed in claim 1, wherein the two guide flanges are positioned at opposite sides of said slider and said Oldham coupling further comprises:

restricting means provided on said slider and one of said two guide flanges adjoining said press drum for restricting a position in which said slider and the one guide flange mate with each other.

3. A stencil printer as claimed in claim 1, wherein said Oldham coupling comprises:

an American Oldham coupling.

4. A stencil printer comprising:

a cylindrical ink drum including ink feeding means and rotatable with a perforated master wrapped around a periphery thereof;

recording medium feeding means for feeding a recording medium;

a cylindrical press drum for retaining the recording medium fed from the recording medium feeding means on a periphery thereof, and rotatable in a direction opposite to a direction of rotation of said ink drum while pressing the recording medium against said ink drum;

moving means for selectively moving said press drum into or out of contact with said ink drum in synchronism with a feed of the recording medium to thereby prevent said press drum from contacting said ink drum when the recording medium is absent between said press drum and said ink drum; and drive transmitting means for connecting said press drum and a press drum driveline arranged on stationary members which are not influenced by a displacement of said press drum caused by said moving means, and for causing, during and before and after the displacement of said press drum, said press drum to rotate smoothly in accordance with a rotation of said press drum driveline without any variation in speed despite the displacement of said press drum;

wherein said drive transmitting means includes an Oldham coupling including a slider, two guide flanges positioned at opposite sides of said slider, and hooks unlockably locking said slider to one of said two guide flanges adjoining said drive transmitting means.

5. A stencil printer comprising:

a cylindrical ink drum including ink feeding means and rotatable with a perforated master wrapped around a periphery thereof;

recording medium feeding means for feeding a recording medium;

a cylindrical press drum for retaining the recording medium fed from the recording medium feeding means on a periphery thereof, and rotatable in a direction opposite to a direction of rotation of said ink drum while pressing the recording medium against said ink drum;

moving means for selectively moving said press drum into or out of contact with said ink drum in synchronism with a feed of the recording medium to thereby prevent said press drum from contacting said ink drum when the recording medium is absent between said press drum and said ink drum; and drive transmitting means for connecting said press drum and a press drum driveline arranged on stationary members which are not influenced by a displacement of said press drum caused by said moving means, and for causing, during and before and after the displacement of said press drum, said press drum to rotate smoothly in accordance with a rotation of said press drum driveline without any variation in speed despite the displacement of said press drum;

wherein said stencil printer further includes positioning means for moving the press drum in the axial direction of the press drum.

* * * * *